US011228120B2

(12) United States Patent
Song et al.

(10) Patent No.: US 11,228,120 B2
(45) Date of Patent: Jan. 18, 2022

(54) ANTENNA AND ELECTRONIC DEVICE INCLUDING THE SAME

(71) Applicant: Samsung Electronics Co., Ltd., Gyeonggi-do (KR)

(72) Inventors: Youngman Song, Gyeonggi-do (KR); Wooyoung Jeong, Gyeonggi-do (KR); Gwangun Oh, Gyeonggi-do (KR); Youngmoon Park, Gyeonggi-do (KR); Jongmin Lee, Gyeonggi-do (KR)

(73) Assignee: Samsung Electronics Co., Ltd

( * ) Notice: Subject to any disclaimer, the term of this patent is extended or adjusted under 35 U.S.C. 154(b) by 38 days.

(21) Appl. No.: 16/682,852

(22) Filed: Nov. 13, 2019

(65) Prior Publication Data

US 2020/0169007 A1 May 28, 2020

(30) Foreign Application Priority Data

Nov. 26, 2018 (KR) ..... 10-2018-0147802

(51) Int. Cl.
*H01Q 21/29* (2006.01)
*H01Q 1/22* (2006.01)
*H01Q 21/00* (2006.01)

(52) U.S. Cl.
CPC ..... *H01Q 21/293* (2013.01); *H01Q 1/22* (2013.01); *H01Q 21/0006* (2013.01)

(58) Field of Classification Search
CPC ..... H01Q 21/29; H01Q 21/293; H01Q 1/22; H01Q 1/2283; H01Q 1/2291; H01Q 1/241–243
See application file for complete search history.

(56) References Cited

U.S. PATENT DOCUMENTS 9,905,922 B2 2/2018 Lee et al.
10,868,371 B2 * 12/2020 Desclos ..... H01Q 21/0075
2002/0019247 A1 2/2002 Egorov
(Continued)

FOREIGN PATENT DOCUMENTS

CN 108448230 8/2018
JP 2005-136521 5/2005
(Continued)

OTHER PUBLICATIONS

International Search Report dated Feb. 12, 2020 issued in counterpart application No. PCT/KR2019/014593, 3 pages.

*Primary Examiner* — Jason Crawford
(74) *Attorney, Agent, or Firm* — The Farrell Law Firm, P.C.

(57) ABSTRACT

An electronic device is provided. The electronic device includes a housing, and a printed circuit board (PCB) disposed in an inner space of the housing and includes at least one first conductive contact exposed at least partially and electrically connected to a wireless communication circuit; and an antenna structure disposed on the PCB, including at least one first antenna element and at least one second conductive contact exposed at least partially and electrically connected to the at least one first antenna element. The at least one first conductive contact is electrically connected to the at least one second conductive contact when the antenna structure is combined with the PCB. The wireless communication circuit is configured to form a directional beam through the at least one first antenna element.

20 Claims, 24 Drawing Sheets

(56) References Cited

U.S. PATENT DOCUMENTS

| | | | | |
|---|---|---|---|---|
| 2012/0007784 | A1 | 1/2012 | Ling et al. | |
| 2013/0194143 | A1* | 8/2013 | Bungo | H01Q 21/28 343/725 |
| 2013/0257659 | A1* | 10/2013 | Darnell | H05K 1/181 343/702 |
| 2013/0342411 | A1* | 12/2013 | Jung | H01Q 1/243 343/767 |
| 2016/0248169 | A1 | 8/2016 | Mohammadian et al. | |
| 2017/0244153 | A1* | 8/2017 | Chen | H01Q 1/48 |
| 2017/0250460 | A1* | 8/2017 | Shin | H04M 1/0266 |
| 2018/0034134 | A1* | 2/2018 | Dalmia | H01Q 19/30 |
| 2018/0269561 | A1* | 9/2018 | Kim | H01Q 1/085 |
| 2019/0103653 | A1* | 4/2019 | Jeong | H01L 25/0655 |
| 2019/0166809 | A1* | 6/2019 | Yu | F04D 15/0016 |
| 2019/0229399 | A1* | 7/2019 | Wang | H01Q 1/242 |
| 2019/0229404 | A1* | 7/2019 | Xia | H01Q 21/08 |
| 2019/0229405 | A1* | 7/2019 | Xia | H01Q 1/243 |
| 2020/0153086 | A1* | 5/2020 | Park | H01Q 13/18 |

FOREIGN PATENT DOCUMENTS

| | | |
|---|---|---|
| JP | 2005-318329 | 11/2005 |
| KR | 1020170101310 | 9/2017 |

* cited by examiner

50% Tilt

Default

ANTENNA AND ELECTRONIC DEVICE INCLUDING THE SAME

CROSS-REFERENCE TO RELATED APPLICATION(S)

This application is based on and claims priority under 35 U.S.C. § 119 to Korean Patent Application No. 10-2018-0147802, filed on Nov. 26, 2018, in the Korean Intellectual Property Office, the entire disclosure of which is incorporated herein by reference.

BACKGROUND

1. Field

The present disclosure relates generally to an antenna and an electronic device including the antenna.

2. Description of Related Art

With the growth of wireless communication technology, a great variety of electronic devices (e.g., electronic devices for communication) are being widely used all over the world. In addition, the use of multimedia contents over a communication network is increasing exponentially, so that network capacity is gradually reaching a limit. After the commercialization of a 4th generation (4G) communication system, a next-generation communication system (e.g., a 5th generation (5G) communication system, a pre-5G communication system, or a new radio (NR) communication system) using a super-high frequency (e.g. mmWave) band (e.g., 3 GHz to 300 GHz band) is now being studied in order to satisfy the increasing demands of radio data traffic.

Next-generation wireless communication technologies are currently developed to permit signal transmission/reception using frequencies in the range of 3 GHz to 100 GHz, to overcome a high free space loss due to frequency characteristics, to implement an efficient mounting structure for increasing an antenna gain, and to realize a corresponding new antenna structure. This antenna structure may include an array-type antenna module in which various numbers of antenna elements are arranged at regular intervals. These antenna elements may be disposed on one planar printed circuit board (PCB). In addition, some antenna elements (e.g., conductive patch antennas) may be arranged to form a beam pattern in a first direction, and other antenna elements (e.g., dipole antennas) may be arranged to form a beam pattern in a direction perpendicular to the first direction.

However, an antenna module having antenna elements arranged side by side on a single PCB may have difficulty in securing a mounting space inside an electronic device which is gradually becoming slimmer. Further, the antenna module may not be available for an electronic device that requires beam patterns to be formed in different directions.

SUMMARY

An aspect of the present disclosure provides an antenna capable of securing a mounting space and an electronic device including the antenna.

Another aspect of the present disclosure provides an antenna including an antenna module in which antenna elements are arranged to form beam patterns in different directions, and an electronic device including the antenna.

According to an embodiment of the present disclosure, an electronic device is provided. The electronic device includes a housing, a PCB disposed in an inner space of the housing and including at least one first conductive contact exposed at least partially and electrically connected to a wireless communication circuit, and an antenna structure disposed on the PCB, including at least one first antenna element, and at least one second conductive contact exposed at least partially and electrically connected to the at least one first antenna element, wherein the at least one first conductive contact is electrically connected to the at least one second conductive contact when the antenna structure is combined with the PCB, and wherein the wireless communication circuit may be configured to form a directional beam through the at least one first antenna element.

BRIEF DESCRIPTION OF THE DRAWINGS

The above and other aspects, features, and advantages of certain embodiments of the present disclosure will be more apparent from the following description taken in conjunction with the accompanying diagrams, in which.

DETAILED DESCRIPTION

Hereinafter, embodiments of the present disclosure are described below in detail with reference to the accompanying drawings.

Figure 1:
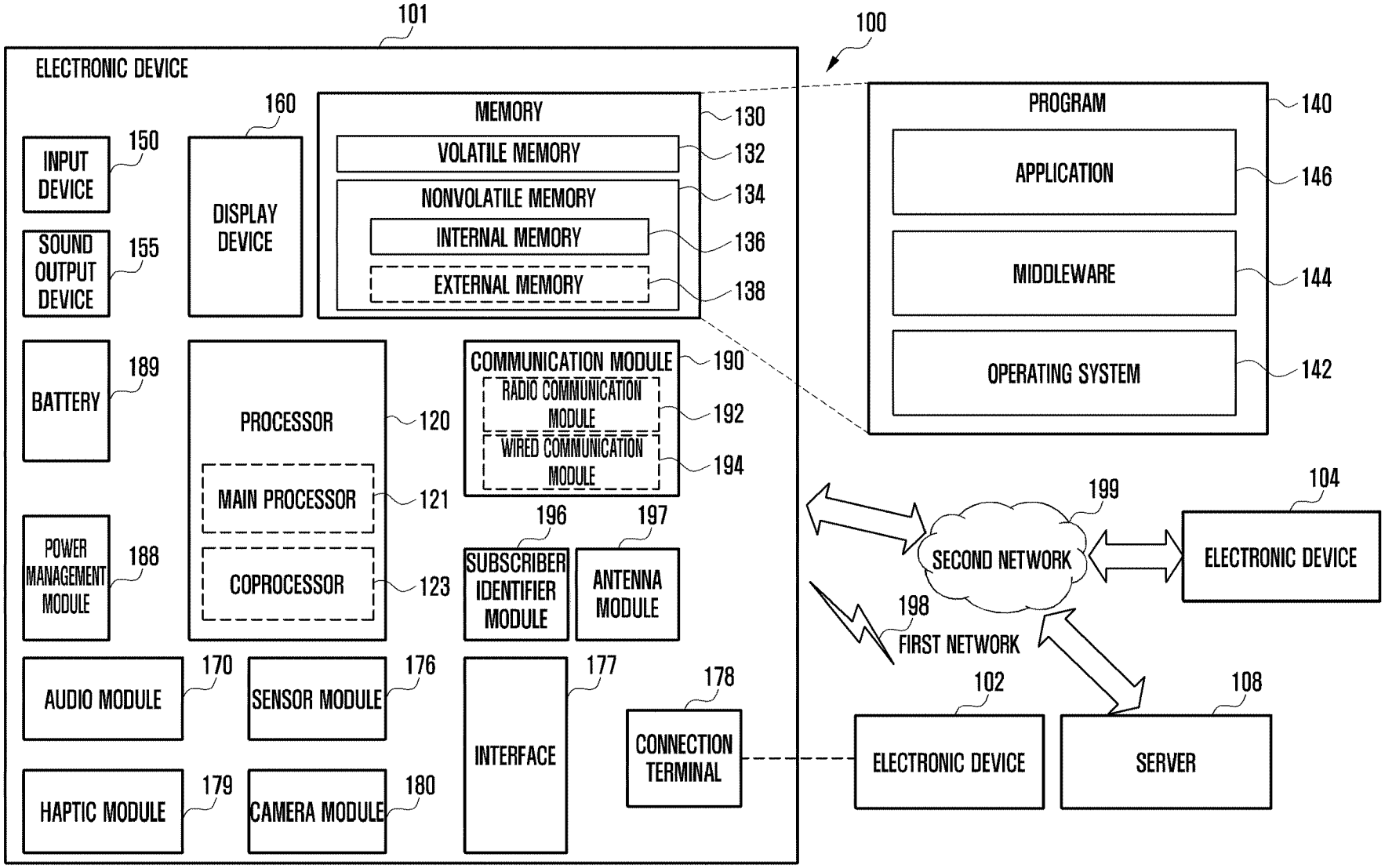
FIG. 1 is a block diagram of an electronic device in a network environment according to an embodiment.

FIG. 1 is a block diagram of an electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 may include a processor 120, memory 130, an input device 150, a sound output device 155, a display device 160, an audio module 170, a sensor module 176, an interface 177, a connection terminal 178, a haptic module 179, a camera module 180, a power management module 188, a battery 189, a communication module 190, a subscriber identification module (SIM) 196, or an antenna module 197. At least one (e.g., the display device 160 or the camera module 180) of the components may be omitted from the electronic device 101, or one or more other components may be added in the electronic device 101. Some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or a software component) of the electronic device 101 coupled with the processor 120, and may perform various data processing or computation. As at least part of data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and a coprocessor 123 (e.g., a graphics processing unit (GPU), an image signal processor (ISP), a sensor hub processor, or a communication processor (CP)) that is operable independently from, or in conjunction with, the main processor 121. Additionally or alternatively, the coprocessor 123 may be adapted to consume less power than the main processor 121, or to be specific to a specified function. The coprocessor processor 123 may be implemented as separate from, or as part of, the main processor 121.

The coprocessor processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The coprocessor processor 123 (e.g., an image signal processor (ISP) or a CP) may be implemented as part of another component (e.g., the camera module 180 or the communication module 190) functionally related to the coprocessor processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or a record, and the receiver may be used for incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, the hologram device, and the projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the sound output device 155 or a headphone of an external electronic device (e.g., the electronic device 102) directly or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the electronic device 102 directly (e.g., wiredly) or wirelessly. The interface 177 may include, for example, a high definition multimedia interface (HDMI), a universal serial bus (USB) interface, a secure digital (SD) card interface, or an audio interface.

The connecting terminal 178 may include a connector via which the electronic device 101 may be physically connected with the electronic device 102. The connecting terminal 178 may include, for example, an HDMI connector, a USB connector, an SD card connector, or an audio connector (e.g., a headphone connector).

The haptic module 179 may convert an electrical signal into a mechanical stimulus (e.g., a vibration or a movement) or electrical stimulus which may be recognized by a user via tactile sensation or kinesthetic sensation. The haptic module 179 may include, for example, a motor, a piezoelectric element, or an electric stimulator.

The camera module 180 may capture a still image or moving images. The camera module 180 may include one or more lenses, image sensors, ISPs, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the electronic device 102, the electronic device 104, or the server 108 and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or a standard of the Infrared Data Association (IrDA)) or the second network 199 (e.g., a long-range communication network, such as a cellular network, the Internet, or a computer network (e.g., LAN or wide area network (WAN)). These various types of communication modules may be implemented as a single component (e.g., a single integrated circuit or chip), or may be implemented as multi components (e.g., multi chips) separate from each other. The wireless communication module 192 may identify and authenticate the electronic device 101 in a communication network, such as the first network 198 or the second network 199, using subscriber information (e.g., an international mobile subscriber identity (IMSI)) stored in the SIM 196.

The antenna module 197 may transmit or receive a signal or power to or from the outside (e.g., the external electronic device) of the electronic device 101. The antenna module may include a single antenna having a radiator formed of a conductor or conductive pattern on a PCB. The antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna. Any component (e.g., a radio frequency integrated circuit (RFIC)) other than the radiator may be further formed as part of the antenna module 197.

At least some of the above-described components may be coupled mutually and communicate signals (e.g., commands or data) therebetween via an inter-peripheral communication scheme (e.g., a bus, a general purpose input and output (GPIO), a serial peripheral interface (SPI), or a mobile industry processor interface (MIPI)).

Commands or data may be transmitted or received between the electronic device 101 and the external electronic device 104 via the server 108 coupled with the second network 199. Each of the electronic device 102 and the electronic device 104 may be a device of a same type as, or a different type from, the electronic device 101. All or some operations to be executed at the electronic device 101 may be executed at one or more of the electronic device 102, the electronic device 104, or the server 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer a resulting outcome to the electronic device 101. The electronic device 101 may provide the outcome, with or without further processing of the outcome, as at least part of a reply to the request. To that end, a cloud computing, distributed computing, or client-server computing technology may be used, for example.

The electronic device may be one of various types of electronic devices. The electronic devices may include, for example, a portable communication device (e.g., a smart phone), a computer device, a portable multimedia device, a portable medical device, a camera, a wearable device, or a home appliance. The electronic devices are not limited to those described above.

Various embodiments of the present disclosure and the terms used herein are not intended to limit the disclosure set forth herein to particular embodiments but include various changes, equivalents, or replacements for a corresponding embodiment. With regard to the description of the corresponding drawings, similar reference numerals may be used to refer to similar or related elements. A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "$1^{st}$", "$2^{nd}$", "first", and "second" may be used to simply distinguish a corresponding component from another component, but does not limit the components in another aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it indicates that the element may be coupled with the other element directly (e.g., wiredly), wirelessly, or via a third element.

As used herein, the term "module" may include a unit implemented in hardware, software, or firmware, and may be used interchangeably with other terms, for example, "logic", "logic block", "part", or "circuitry". A module may be a single integral component, or a minimum unit or part thereof, adapted to perform one or more functions. For example, a module may be implemented in a form of an application-specific integrated circuit (ASIC).

Various embodiments as set forth herein may be implemented as software (e.g., the program 140) including one or more instructions that are stored in a storage medium (e.g., an internal memory 136 or an external memory 138 in the nonvolatile memory 134) that is readable by a machine (e.g., the electronic device 101). For example, a processor (e.g., the processor 120) of the machine (e.g., the electronic device 101) may invoke at least one of the one or more instructions stored in the storage medium, and execute the at least one of the one or more instructions, with or without using one or more other components under the control of the processor. This allows the machine to be operated to perform at least one function according to the at least one instruction invoked. The one or more instructions may include code generated by a complier or code executable by an interpreter. The machine-readable storage medium may be provided in the form of a non-transitory storage medium. The term "non-transitory" indicates that the storage medium is a tangible device, but does not include a signal (e.g., an electromagnetic wave), and does not differentiate between where data is semi-permanently stored in the storage medium and where the data is temporarily stored in the storage medium.

A method according to various embodiments of the present disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, one or more of the operations may be executed in a different order or omitted, or one or more other operations may be added.

Figure 2:
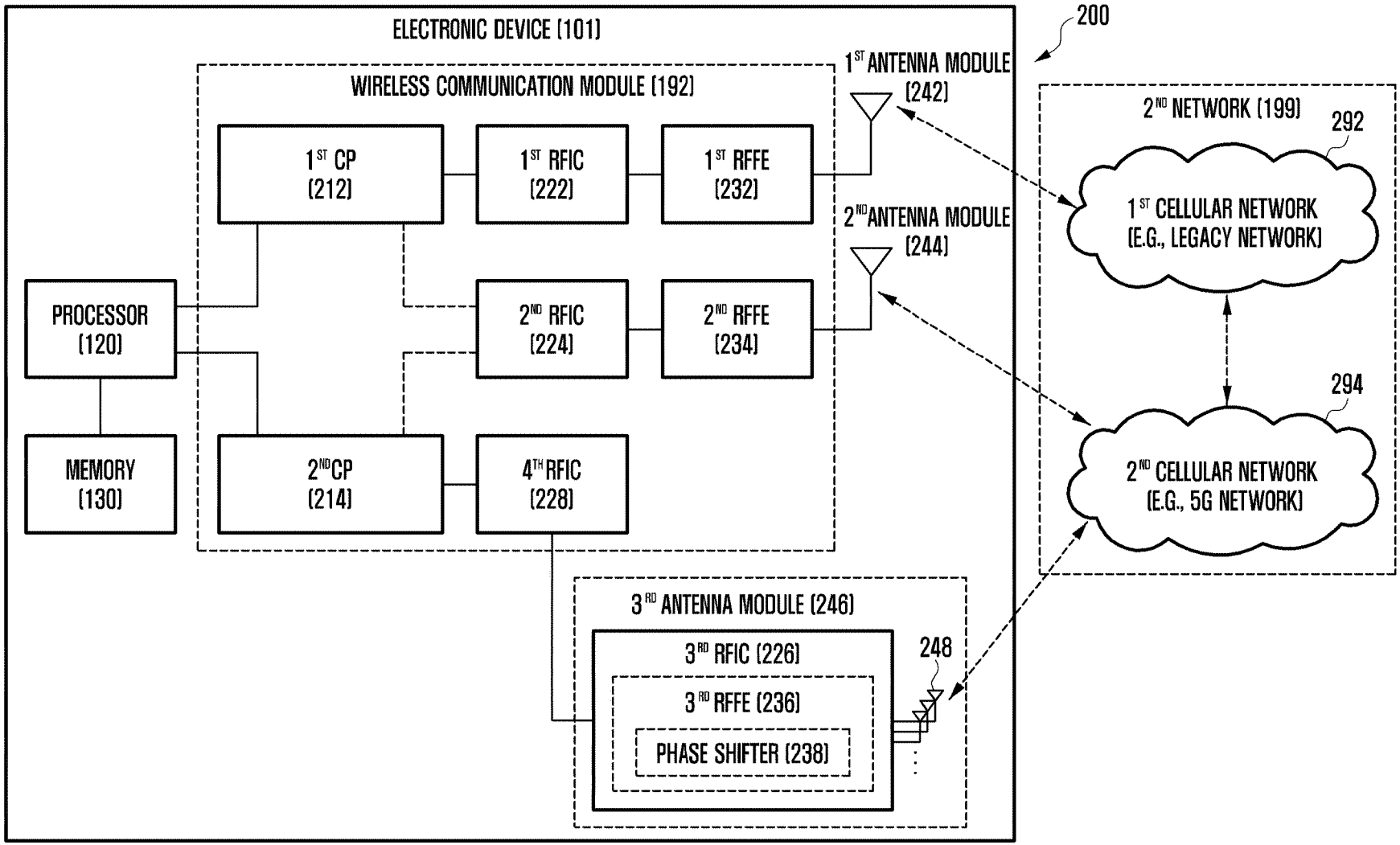
FIG. 2 is a block diagram of an electronic device in a network environment including a plurality of cellular networks according to an embodiment.

FIG. 2 is a block diagram 200 of an electronic device 101 in a network environment including a plurality of cellular networks according to an embodiment.

Referring to FIG. 2, the electronic device 101 may include a first CP 212, a second CP 214, a first RFIC 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include a processor 120 and a memory 130. A second network 199 may include a first cellular network 292 and a second cellular network 294. The electronic device 101 may further include at least one of components shown in, and described with reference to, FIG. 1, and the second network 199 may further include at least one other network. The first CP 212, the second CP 214, the first RFIC 222, the second RFIC 224, the fourth RFIC 228, the first RFFE 232, and the second RFFE 234 may form a wireless communication module 192. The fourth RFIC 228 may be omitted or included as part of the third RFIC 226.

The first CP 212 may establish a communication channel in a band to be used for wireless communication with the first cellular network 292 and support legacy network communication over the established communication channel. The first cellular network 292 may be a legacy network such as a 2G, a 3G, a 4G, or a long term evolution (LTE) network. The second CP 214 may establish a communication channel corresponding to a designated band (e.g., from about 6 GHz to about 60 GHz) in a band to be used for wireless communication with the second cellular network 294, and support 5G network communication over the established communication channel. The second cellular network 294 may be a 5G network defined in the third generation partnership project (3GPP). Additionally, the first CP 212 or the second CP 214 may establish a communication channel corresponding to another designated band (e.g., below about 6 GHz) in the band to be used for wireless communication with the second cellular network 294, and support 5G network communication over the established communication channel. The first CP 212 and the second CP 214 may be implemented in a single chip or a single package. The first CP 212 or the second CP 214 may be formed in a single chip or a single package together with the processor 120 (e.g., the coprocessor processor 123) or the communication module 190 as shown in FIG. 1.

The first RFIC 222 may convert, in case of transmission, a baseband signal generated by the first CP 212 into a radio frequency (RF) signal of about 700 MHz to about 3 GHz to be used in the first cellular network 292 (e.g., a legacy network). In case of reception, an RF signal may be obtained from the first cellular network 292 via an antenna (e.g., the first antenna module 242) and preprocessed through an RFFE (e.g., the first RFFE 232). Then, the first RFIC 222 may convert the preprocessed RF signal into a baseband signal to be processed by the first CP 212.

The second RFIC 224 may convert, in case of transmission, a baseband signal generated by the first CP 212 or the second CP 214 into an RF signal (hereinafter, referred to as a 5G Sub6 RF signal) of a Sub6 band (e.g., about 6 GHz or less) to be used in the second cellular network 294 (e.g., the 5G network). In case of reception, a 5G Sub6 RF signal may be obtained from the second cellular network 294 via an antenna (e.g., the second antenna module 244) and preprocessed through an RFFE (e.g., the second RFFE 234). Then, the second RFIC 224 may convert the preprocessed 5G Sub6 RF signal into a baseband signal to be processed by a corresponding one of the first CP 212 and the second CP 214.

The third RFIC 226 may convert, in case of transmission, a baseband signal generated by the second CP 214 into an RF signal (hereinafter, referred to as a 5G Above6 RF signal) of a 5G Above6 band (e.g., from about 6 GHz to about 60 GHz) to be used in the second cellular network 294 (e.g., the 5G network). In case of reception, a 5G Above6 RF signal may be obtained from the second cellular network 294 via an antenna (e.g., the antenna 248) and preprocessed through a third RFFE 236 in the third RFIC 226. Then, the third RFIC 226 may convert the preprocessed 5G Above6 RF signal into a baseband signal to be processed by the second CP 214. The third RFFE 236 may be formed as part of the third RFIC 226.

The electronic device 101 may include the fourth RFIC 228 either separately from or as part of the third RFIC 226. The fourth RFIC 228 may convert, in case of transmission, a baseband signal generated by the second CP 214 to an RF signal (hereinafter, referred to as an intermediate frequency (IF) signal) of an IF band (e.g., from about 9 GHz to about 11 GHz) and then transmit the IF signal to the third RFIC 226. The third RFIC 226 may convert the IF signal into a 5G Above6 RF signal. In case of reception, a 5G Above6 RF signal may be received from the second cellular network 294 (e.g., the 5G network) via an antenna (e.g., the antenna 248) and converted into an IF signal by the third RFIC 226. The fourth RFIC 228 may convert the IF signal into a baseband signal to be processed by the second CP 214.

The first RFIC 222 and the second RFIC 224 may be implemented as at least part of a single chip or package. The first RFFE 232 and the second RFFE 234 may be implemented as at least part of a single chip or package. At least one of the first antenna module 242 and the second antenna module 244 may be omitted or combined with another antenna module to process RF signals of a plurality of bands.

The third RFIC 226 and the antenna 248 may be disposed on the same PCB to form a third antenna module 246. For example, the wireless communication module 192 or the processor 120 as shown in FIG. 1 may be disposed on a first PCB (or a main PCB). In this case, the third RFIC 226 may be disposed on a portion (e.g., a lower surface) of a second PCB (or a sub PCB), which is different from the first PCB, and the antenna 248 may be disposed on another portion (e.g., an upper surface) of the second PCB, so that the third antenna module 246 may be formed. Disposing the third RFIC 226 and the antenna 248 on the same PCB may reduce the length of a transmission line therebetween. This is advantageous for reducing loss (e.g., attenuation) of signals, caused by the transmission line, in a super-high frequency band (e.g., about 6 GHz to about 60 GHz) used for the 5G network communication. Therefore, the electronic device 101 improves the quality or speed of communication with the second cellular network 294 (e.g., the 5G network).

The antenna 248 may be formed of an antenna array that includes a plurality of antenna elements that may be used for beamforming. In this case, the third RFIC 226 may include a plurality of phase shifters 238, as part of the third RFFE 236, corresponding to the plurality of antenna elements. In case of transmission, the plurality of phase shifters 238 may convert the phases of 5G Above6 RF signals to be transmitted to an external entity (e.g., a base station of the 5G network) outside the electronic device 101 via the corresponding antenna elements. In case of reception, the plurality of phase shifters 238 may convert the phases of 5G Above6 RF signals, respectively received from the external entity through the corresponding antenna elements, to the same or substantially same phase. This enables transmission/reception between the electronic device 101 and the external entity through beamforming.

The second cellular network 294 (e.g., the 5G network) may be operated independently of (e.g., Stand-Alone (SA)) or in combination with (e.g., Non-Stand Alone (NSA)) the first cellular network 292 (e.g., the legacy network). For example, the 5G network may have only an access network (e.g., a 5G radio access network (RAN) or a next generation RAN (NG RAN)) without a core network (e.g., a next generation core (NGC)). In this case, the electronic device 101 may access the access network of the 5G network and then access an external network (e.g., the Internet) under the control of a core network (e.g., an evolved packed core (EPC)) of the legacy network. Protocol information (e.g., LTE protocol information) for communication with the legacy network or protocol information (e.g., NR protocol information) for communication with the 5G network is stored in the memory 230 and is accessible to another component (e.g., the processor 120, the first CP 212, or the second CP 214).

Figure 3A:
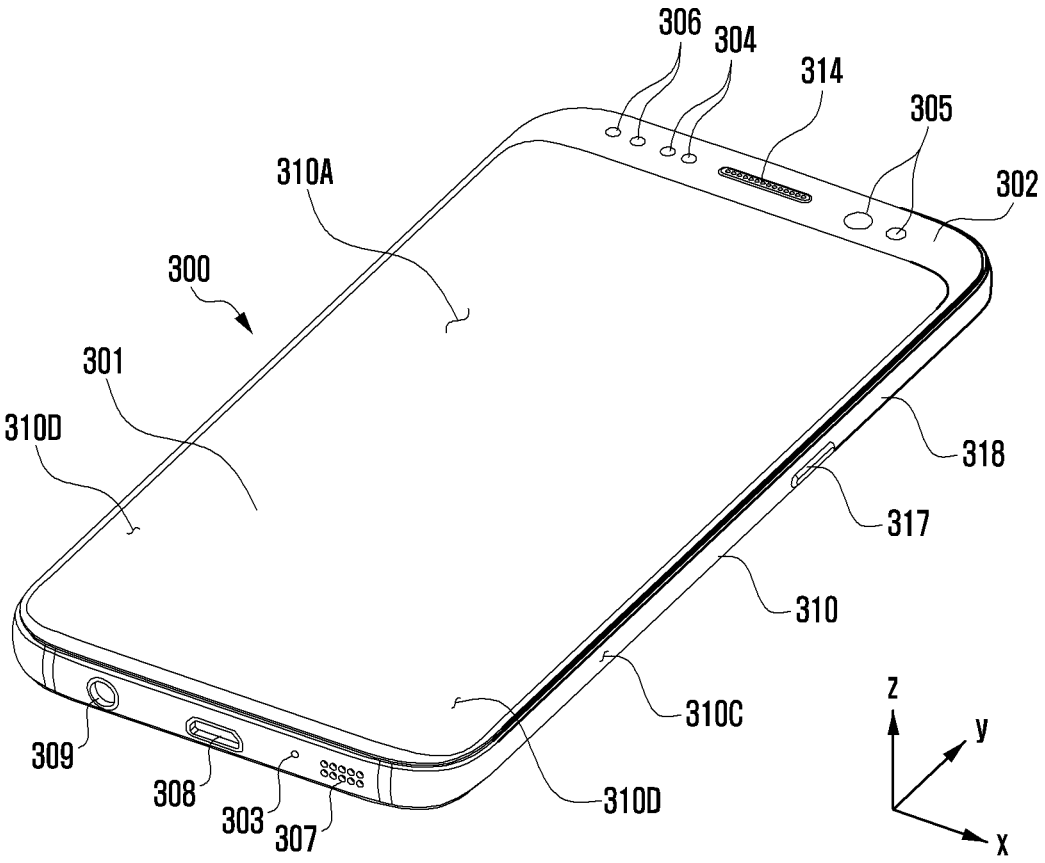
FIG. 3A is a perspective view of a front surface of a mobile electronic device according to an embodiment.
Figure 3B:
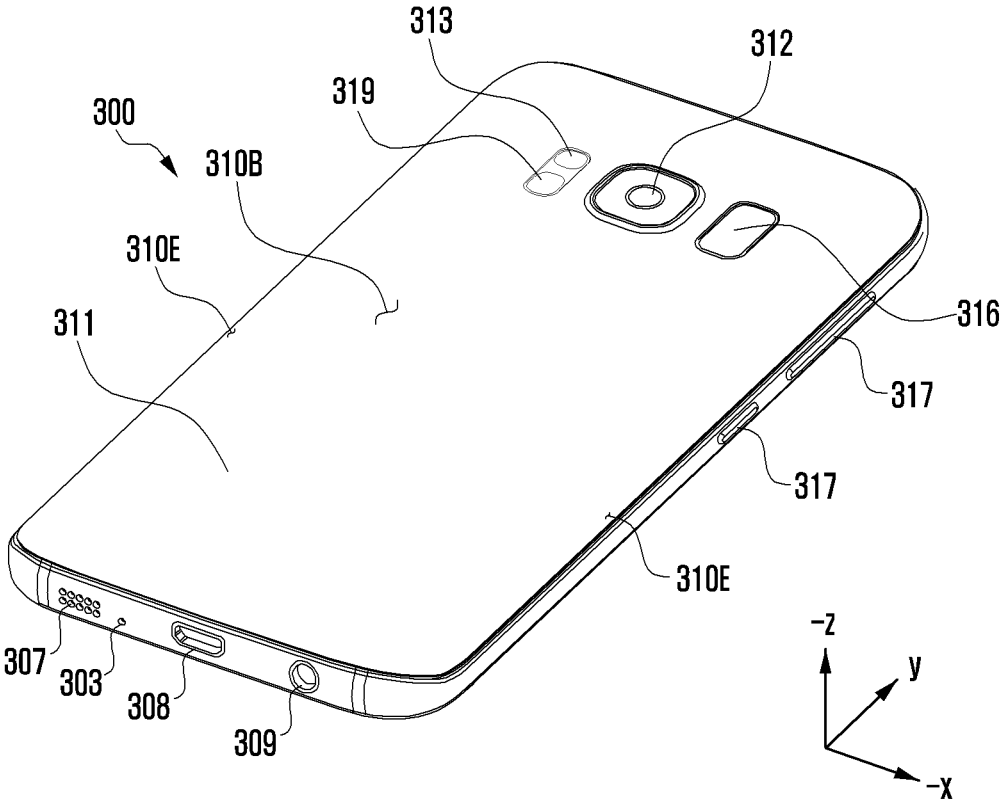
FIG. 3B is a perspective view of a rear surface of the mobile electronic device shown in FIG. 3A according to an embodiment.

FIG. 3A is a perspective view of a front surface of a mobile electronic device 300 according to an embodiment, and FIG. 3B is a perspective view of a rear surface of the mobile electronic device 300 shown in FIG. 3A.

Referring to FIGS. 3A and 3B, the mobile electronic device 300 according to an embodiment may include a housing 310 that includes a first surface (or front surface) 310A, a second surface (or rear surface) 310B, and a lateral surface 310C that surrounds a space between the first surface 310A and the second surface 310B. The housing may refer to a structure that forms a part of the first surface 310A, of the second surface 310B, and of the lateral surface 310C. The first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or lateral member) 318 which is combined with the front plate 302 and the rear plate 311 and includes a metal and/or polymer. The rear plate 311 and the lateral bezel structure 318 may be integrally formed and may have the same material (e.g., a metallic material such as aluminum).

The front plate 302 may include two first regions 310D disposed at long edges thereof, respectively, and bent and extended seamlessly from the first surface 310A toward the rear plate 311. Similarly, the rear plate 311 may include two second regions 310E disposed at long edges thereof, respectively, and bent and extended seamlessly from the second surface 310B toward the front plate 302. The front plate 302 (or the rear plate 311) may include only one of the first regions 310D (or of the second regions 310E). The first regions 310D or the second regions 310E may not be included in part. When viewed from a lateral side of the electronic device 300, the lateral bezel structure 318 may have a first thickness (or width) on a lateral side where the first or second region 310D or 310E is not included, and may have a second thickness, being less than the first thickness, on another lateral side where the first or second region 310D or 310E is included.

The electronic device 300 may include at least one of a display 301, audio modules 303, 307 and 314, sensor modules 304, 316 and 319, camera modules 305, 312 and 313, a key input device 317, a light emitting device 306, and connector holes 308 and 309. The electronic device 300 may omit at least one (e.g., the key input device 317 or the light emitting device 306) of the above components, or may further include any other component.

The display 301 may be exposed through a substantial portion of the front plate 302, for example. At least a part of the display 301 may be exposed through the front plate 302 that forms the first surface 310A and the first region 310D of the lateral surface 310C. Outlines (e.g., edges and corners) of the display 301 may have substantially the same form as those of the front plate 302. The spacing between the outline of the display 301 and the outline of the front plate 302 may be substantially unchanged in order to enlarge the exposed area of the display 301.

A recess or opening may be formed in a portion of a display area of the display 301 to accommodate at least one of the audio module 314, the sensor module 304, the camera module 305, and the light emitting device 306. At least one of the audio module 314, the sensor module 304, the camera module 305, the fingerprint sensor 316, and the light emitting element 306 may be disposed on the back of the display area of the display 301. The display 301 may be combined with or adjacent to a touch sensing circuit, a pressure sensor capable of measuring the touch strength (pressure), and/or a digitizer for detecting a stylus pen. At least a part of the sensor modules 304 and 319 and/or at least a part of the key input device 317 may be disposed in the first region 310D and/or the second region 310E.

The audio modules 303, 307 and 314 may correspond to a microphone hole 303 and speaker holes 307 and 314, respectively. The microphone hole 303 may contain a microphone disposed therein for acquiring external sounds and, in any case, contain a plurality of microphones to sense a sound direction. The speaker holes 307 and 314 may be classified into an external speaker hole 307 and a call receiver hole 314. Such holes 303, 307 and 314 may be implemented as a single hole, or a speaker (e.g., a piezo speaker) may be provided without the speaker holes 307 and 314.

The sensor modules 304, 316 and 319 may generate electrical signals or data corresponding to an internal operating state of the electronic device 300 or to an external environmental condition. The sensor modules 304, 316 and 319 may include a first sensor module 304 (e.g., a proximity sensor) and/or a second sensor module (e.g., a fingerprint sensor) disposed on the first surface 310A of the housing 310, and/or a third sensor module 319 (e.g., an HRM sensor) and/or a fourth sensor module 316 (e.g., a fingerprint sensor) disposed on the second surface 310B of the housing 310. The fingerprint sensor may be disposed on the second surface 310B as well as the first surface 310A (e.g., the display 301) of the housing 310. The electronic device 300 may further include at least one of a gesture sensor, a gyro sensor, an air pressure sensor, a magnetic sensor, an acceleration sensor, a grip sensor, a color sensor, an IR sensor, a biometric sensor, a temperature sensor, a humidity sensor, or an illuminance sensor.

The camera modules 305, 312 and 313 may include a first camera device 305 disposed on the first surface 310A of the electronic device 300, and a second camera device 312 and/or a flash 313 disposed on the second surface 310B. The camera module 305 or 312 may include one or more lenses, an image sensor, and/or an image signal processor. The flash 313 may include, for example, a light emitting diode or a xenon lamp. Two or more lenses (IR cameras, wide angle and telephoto lenses) and image sensors may be disposed on one side of the electronic device 300.

The key input device 317 may be disposed on the lateral surface 310C of the housing 310. The electronic device 300 may not include some or all of the above-mentioned key input devices 317, and the key input device 317 which is not included may be implemented in any other form such as a soft key on the display 301. The key input device may include the sensor module 316 disposed on the second surface 310B of the housing 310.

The light emitting device 306 may be disposed on the first surface 310A of the housing 310. For example, the light emitting device 306 may provide status information of the electronic device 300 in optical form. The light emitting device 306 may provide a light source associated with the operation of the camera module 305. The light emitting device 306 may include, for example, a light emitting diode (LED), an IR LED, or a xenon lamp.

The connector holes 308 and 309 may include a first connector hole 308 adapted for a connector (e.g., a USB connector) of transmitting and receiving power and/or data to and from an external electronic device, and/or a second connector hole 309 adapted for a connector (e.g., an earphone jack) of transmitting and receiving an audio signal to and from an external electronic device.

Figure 3C:
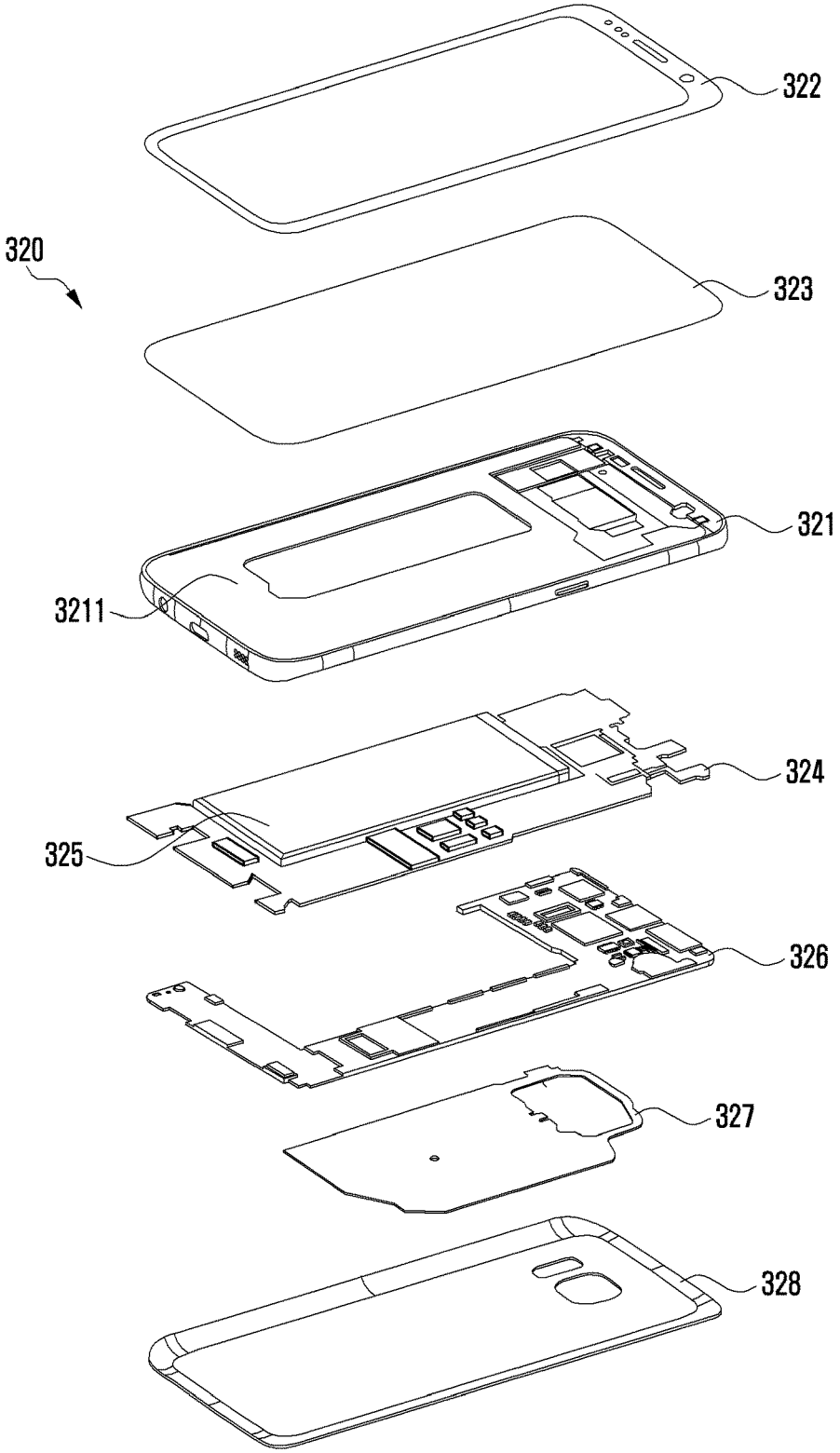
FIG. 3C is an exploded perspective view of a mobile electronic device according to an embodiment.

FIG. 3C is an exploded perspective view of a mobile electronic device 320 according to an embodiment.

Referring to FIG. 3C, the mobile electronic device 320 (e.g., the mobile electronic device 300 in FIGS. 3A and 3B) may include a lateral bezel structure 321, a first support member 3211 (e.g., a bracket), a front plate 322, a display 323, a PCB 324, a battery 325, a second support member 326 (e.g., a rear case), an antenna 327, and a rear plate 328. The electronic device 320 may not include at least one (e.g., the first support member 3211 or the second support member 326) of the above components or may further include any other component. Some components of the electronic device 320 may be the same as or similar to those of the electronic device 300 shown in FIG. 3A or 3B, where descriptions thereof are omitted below.

The first support member 3211 is disposed inside the electronic device 320 and may be connected to or integrated with the lateral bezel structure 321. The first support member 3211 may be formed of, for example, a metal material and/or a non-metal (e.g., polymer) material. The first support member 3211 may be combined with the display 323 at one side thereof and also combined with the PCB 324 at the other side thereof. On the PCB 324, a processor, a memory, and/or an interface may be mounted. The processor may include, for example, one or more of a CPU, an AP, a GPU, an ISP, a sensor hub processor, or a CP.

The memory may include, for example, volatile memory or non-volatile memory.

The interface may include, for example, an HDMI, a USB interface, an SD card interface, and/or an audio interface. The interface may electrically or physically connect the electronic device 300 with an external electronic device and may include a USB connector, an SD card/multimedia card (MMC) connector, or an audio connector.

The battery 325 is a device for supplying power to at least one component of the electronic device 320, and may include, for example, a non-rechargeable primary battery, a rechargeable secondary battery, or a fuel cell. At least a part of the battery 325 may be disposed on substantially the same plane as the PCB 324. The battery 325 may be integrally disposed within the electronic device 320, and may be detachably disposed from the electronic device 320.

The antenna 327 may be disposed between the rear plate 328 and the battery 325. The antenna 327 may include, for example, a near field communication (NFC) antenna, a wireless charging antenna, and/or a magnetic secure transmission (MST) antenna. The antenna 327 may perform short-range communication with an external device, or transmit and receive power required for charging wirelessly. An antenna structure may be formed by a part or combination of the lateral bezel structure 321 and/or the first support member 3211.

Figure 4A:
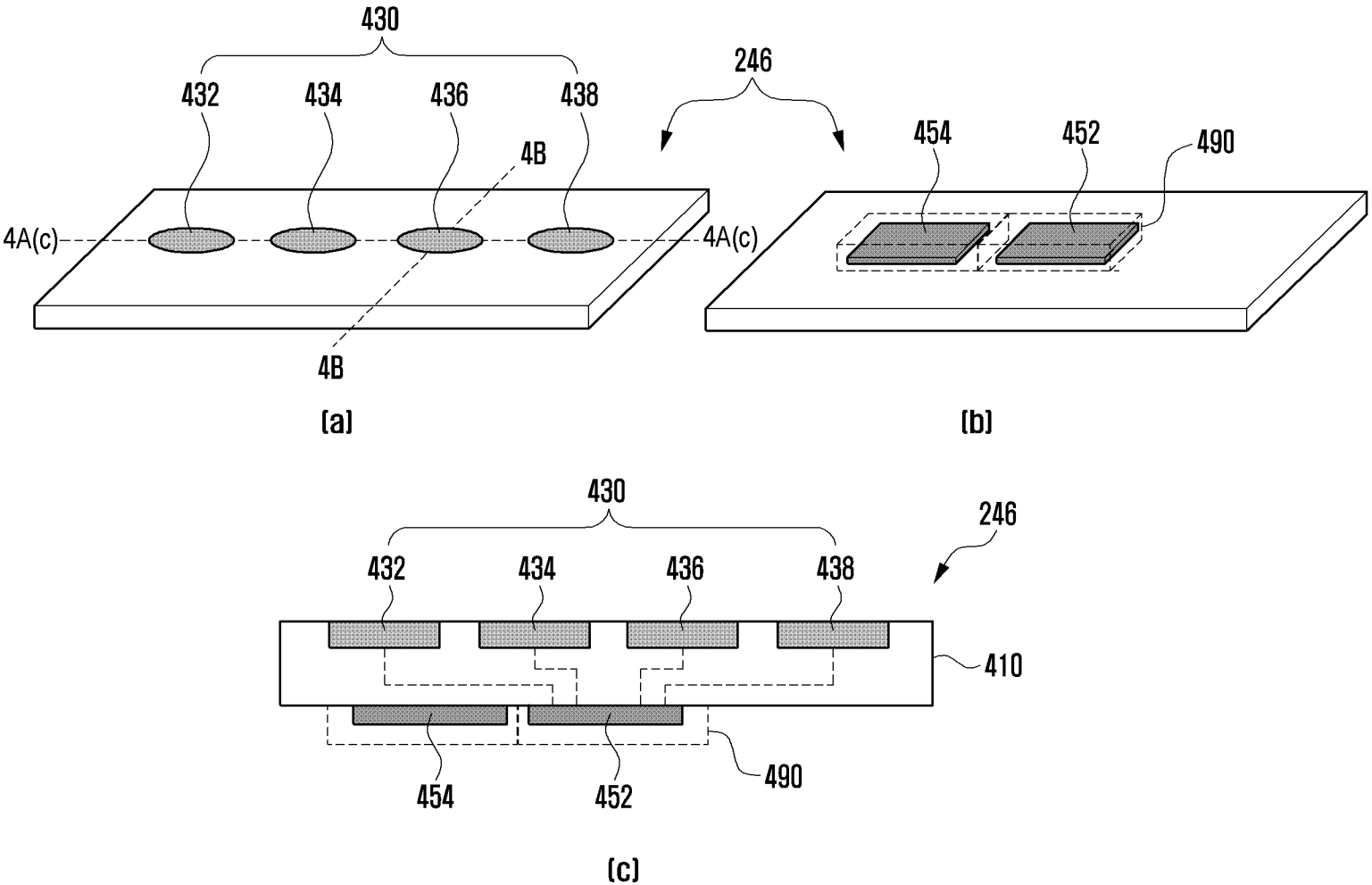
FIG. 4A is an illustration of a structure of the third antenna module shown FIG. 2 according to an embodiment.

FIG. 4A is an illustration of a structure of the third antenna module 246 shown in, and described with reference to, FIG. 2. Specifically, in FIG. 4A, panel (a) is a perspective view showing an upper surface of the third antenna module 246, and panel (b) is a perspective view showing a lower surface of the third antenna module 246. In addition, panel (c) is a cross-sectional view taken along the line 4A(c)-4A(c).

Referring to FIG. 4A, the third antenna module 246 may include a PCB 410, an antenna array 430, an RFIC 452, and a PMIC 454. Optionally, the third antenna module 246 may further include a shielding member 490. At least one of the above-mentioned components may be omitted, or at least two of the above components may be integrally formed.

The PCB 410 may include a plurality of conductive layers and a plurality of non-conductive layers stacked alternately with the conductive layers. Using wirings formed in the conductive layers and conductive vias formed in the non-conductive layers, the PCB 410 may provide electrical connections among various electronic components disposed therein/thereon.

The antenna array 430 (e.g., 248 in FIG. 2) may include a plurality of antenna elements 432, 434, 436, and 438 arranged to form a directional beam. The antenna elements 432, 434, 436, and 438 may be formed on a first surface of the PCB 410 as shown. The antenna array 430 may be formed inside the PCB 410. The antenna array 430 may include a plurality of antenna arrays having the same shape/type or different shapes/types (e.g., a dipole antenna array and/or a patch antenna array).

The RFIC 452 (e.g., 226 in FIG. 2) may be disposed on a second surface, opposite to the first surface, of the PCB 410 to be spaced apart from the antenna array 430. The RFIC 452 is configured to process a signal of a selected frequency band transmitted/received through the antenna array 430. In case of transmission, the RFIC 452 may convert a baseband signal obtained from a communication processor into an RF signal of a specified band. In addition, in case of reception, the RFIC 452 may convert an RF signal received through the antenna array 430 into a baseband signal and then deliver the baseband signal to the communication processor.

In case of transmission, the RFIC 452 may up-convert an IF signal (e.g., about 9 GHz to about 11 GHz), obtained from an IF integrated circuit (IFIC) (e.g., 228 in FIG. 2), to an RF signal of a selected band. In addition, in case of reception, the RFIC 452 may down-convert an RF signal obtained through the antenna array 430, convert the down-converted signal into an IF signal, and then deliver the IF signal to the IFIC.

The PMIC 454 may be disposed on the second surface of the PCB 410 to be spaced apart from the antenna array 430. The PMIC 454 may receive an electric current from a main PCB and provide the necessary power to various components (e.g., the RFIC 452) on the antenna module.

The shielding member 490 may be disposed on the second surface of the PCB 410 to electromagnetically shield at least one of the RFIC 452 and the PMIC 454. The shielding member 490 may be formed of a shield can.

The third antenna module 246 may be electrically coupled to another PCB (e.g., a main PCB) via a module interface. The module interface may include a connecting member such as a coaxial cable connector, a board-to-board connector, an interposer, or a flexible PCB (FPCB). The RFIC 452 and/or the PMIC 454 of the antenna module may be electrically connected to the PCB through the connecting member.

Figure 4B:
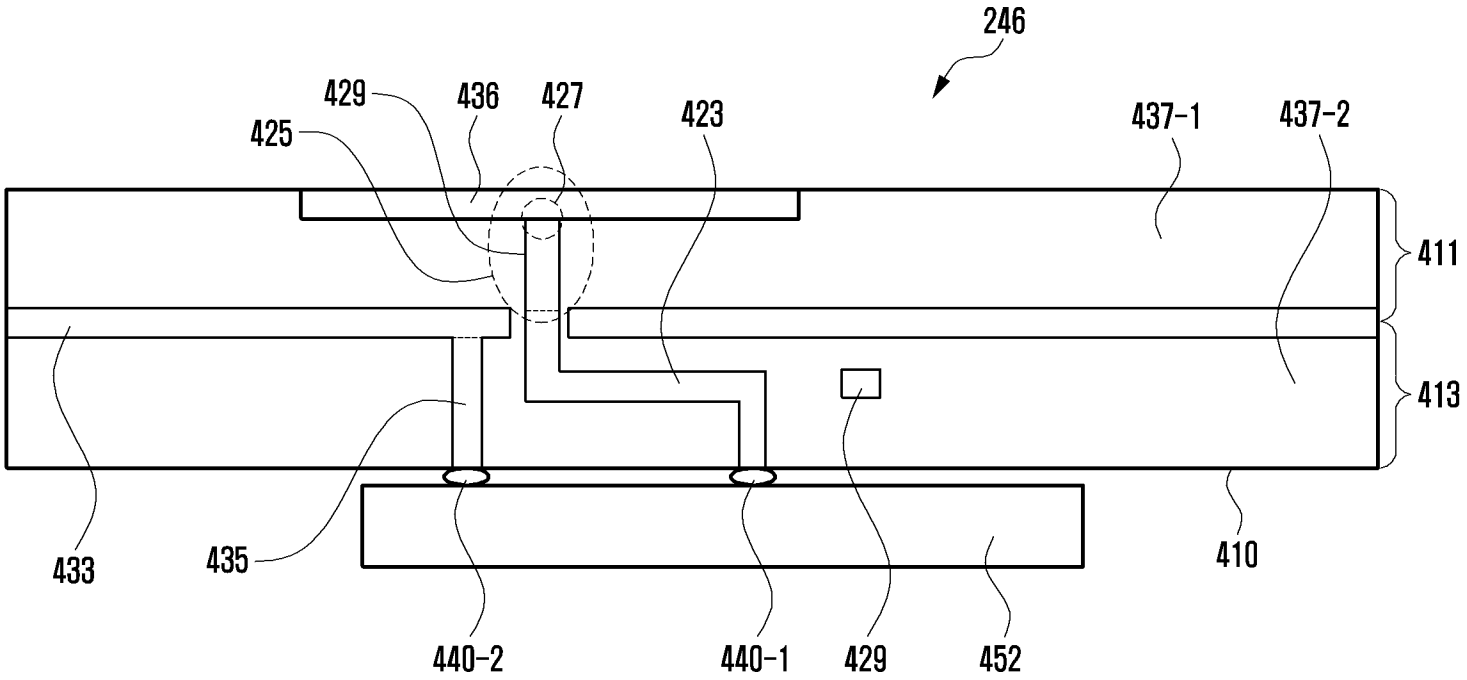
FIG. 4B is a cross-sectional view taken along the line 4B-4B in FIG. 4A according to an embodiment.

FIG. 4B is a cross-sectional view of the third antenna module 246 taken along the line 4A-4A in FIG. 4A. As shown, the PCB 410 may include an antenna layer 411 and a network layer 413.

Referring to FIG. 4B, the antenna layer 411 may include at least one dielectric layer 437-1. In addition, the antenna layer 411 may include an antenna element 436 and/or a power feeder 425, which are formed on or in the dielectric layer 437-1. The power feeder 425 may include a feed point 427 and/or a feed line 429.

The network layer 413 may include at least one dielectric layer 437-2. In addition, the network layer 413 may include at least one ground layer 433, at least one conductive via 435, a transmission line 423, and/or a signal line 429, which are formed on or in the dielectric layer 437-2.

In addition, the RFIC 452 (e.g., the third RFIC 226 in FIG. 2) may be electrically connected to the network layer 413 through, for example, first and second connection members (e.g., solder bumps) 440-1 and 440-2. Various connection members or 20, structures such as soldering or ball grid array (BGA) may be used instead of the above connection members. The RFIC 452 may be electrically connected to the antenna element 436 through the first connection member 440-1, the transmission line 423, and the power feeder 425. In addition, the RFIC 452 may be electrically connected to the ground layer 433 via the second connection member 440-2 and the conductive via 435. The RFIC 452 may also be electrically coupled to the above-mentioned module interface through the signal line 429.

Figure 5A:
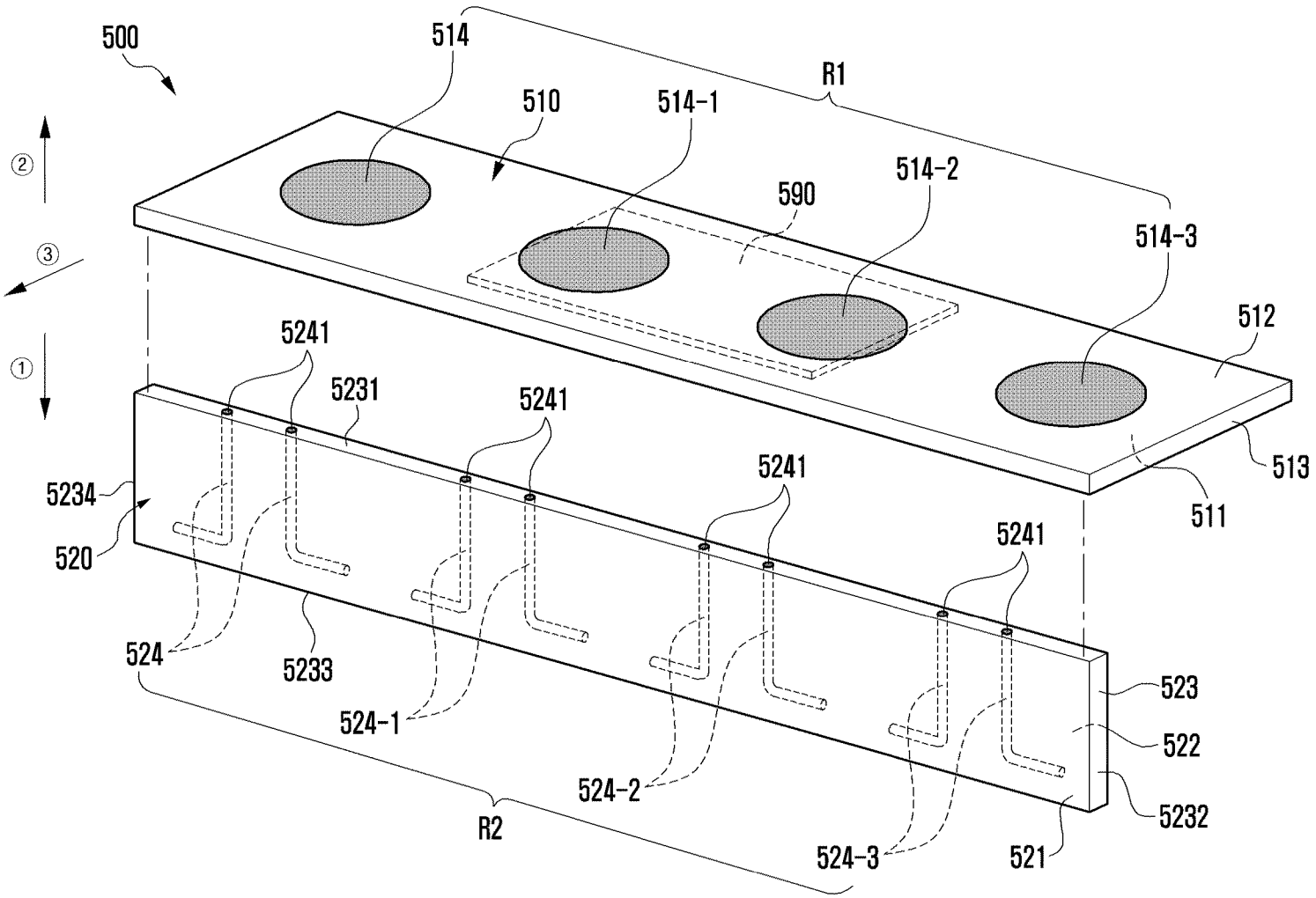
FIG. 5A is a perspective view of a separated state of an antenna module according to an embodiment.
Figure 5B:
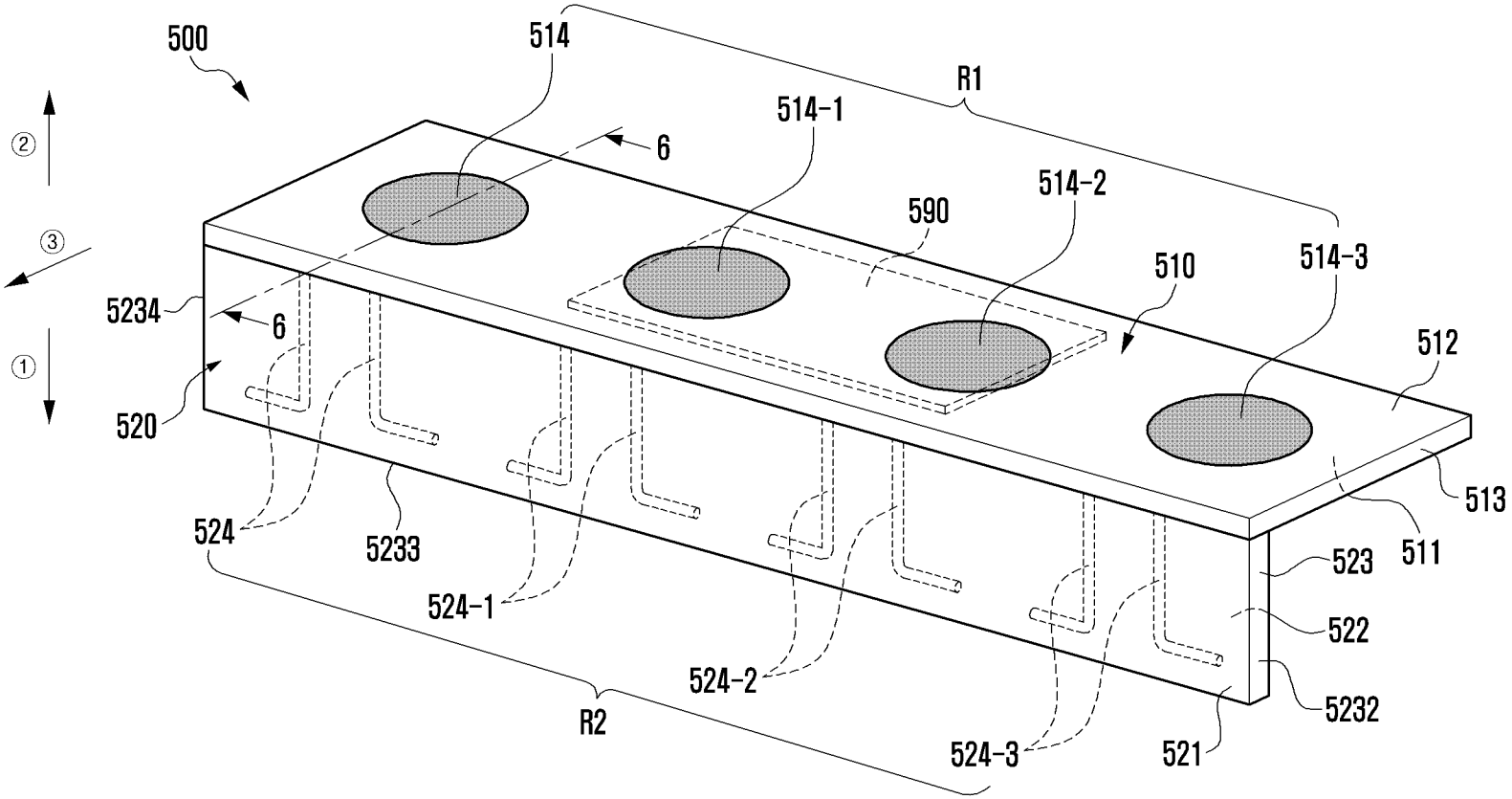
FIG. 5B is a perspective view of a combined state of the antenna module shown in FIG. 5A according to an embodiment.
Figure 5C:
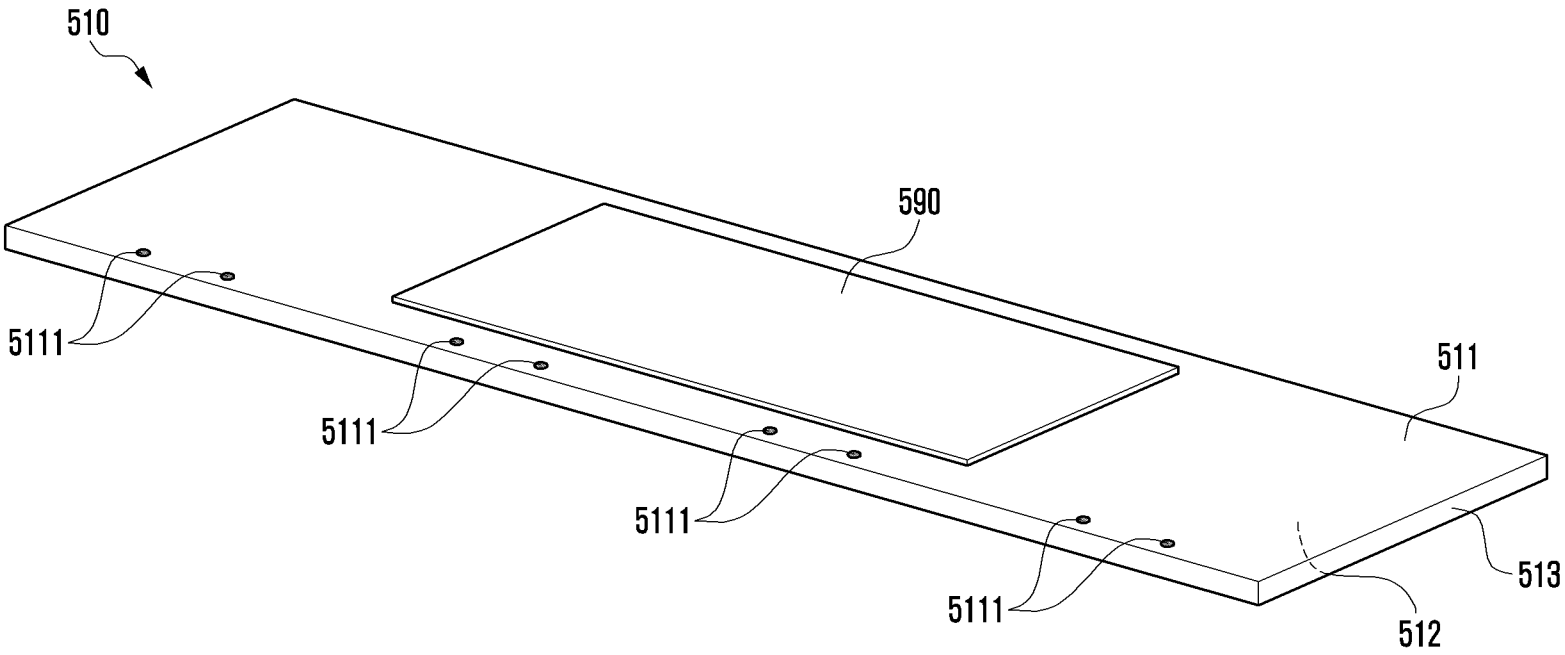
FIG. 5C is a perspective view of a PCB of the antenna module shown in FIG. 5A according to an embodiment.

FIG. 5A is a perspective view of a separated state of an antenna module 500 according to an embodiment. FIG. 5B is a perspective view of a combined state of the antenna module 500 shown in FIG. 5A. FIG. 5C is a perspective view of a printed circuit board 510 of the antenna module 500 shown in FIG. 5A.

Referring to FIGS. 5A, 5B, and 5C, the antenna module 500 of FIG. 5A may be similar, at least in part, to the third antenna module 246 of FIG. 2, or may include other embodiments of the antenna module.

The antenna module 500 may include a PCB 510 and an antenna structure 520 disposed in a direction perpendicular to the PCB 510. The PCB 510 may include a first surface 511 facing a first direction (e.g., the z direction in FIG. 3A), a second surface 512 opposite to the first surface 511 and facing a second direction (e.g., the −z direction in FIG. 3A), and a side surface 513 surrounding a space between the first surface 511 and the second surface 512. The PCB 510 may include a first antenna array R1 that includes a plurality of antenna elements 514, 514-1, 514-2, and 514-3 which are disposed near or exposed through the second surface 512 within the space. The first antenna array R1 may include a first antenna element 514, a second antenna element 514-1, a third antenna element 514-2, and a fourth antenna element 514-3, which are spaced apart at regular intervals. The first antenna array R1 may include a plurality of conductive patches which are formed on the second surface 512 of the PCB 510 or near the second surface 512 within the PCB 510. The PCB 510 may include a wireless communication circuit 590 disposed on the first surface 511. The wireless communication circuit 590 may be electrically connected to the plurality of antenna elements 514, 514-1, 514-2, and 514-3 of the first antenna array R1. The wireless communication circuit 590 may be configured to transmit and/or receive a signal having a frequency between about 3 GHz and 100 GHz through the first antenna array R1.

The antenna structure 520 may include a third surface 521 perpendicular to the first surface 511, a fourth surface 522 opposite to the third surface 521, and a side surface 523 surrounding a space between the third surface 521 and the fourth surface 522. The side surface 523 may include a first side surface 5231 facing the first surface 511 of the PCB 510, a second side surface 5232 vertically extending from the first side surface 5231, a third side surface 5233 extending from the second side surface 5232 in parallel with the first side surface 5231, and a fourth side surface 5234 extending from the third side surface 5233 in parallel with the second side surface 5232. The antenna structure 520 may be formed of a dielectric. In this case, the antenna structure 520 may include an interposer fixed to the PCB 510 and used for electrical connection with another PCB. The antenna structure 520 may be formed of a dielectric substrate including a plurality of dielectric layers.

The antenna structure 520 may include a second antenna array R2 that includes a plurality of other antenna elements 524, 524-1, 524-2, and 524-3 which are disposed at regular intervals in the antenna structure 520. The second antenna array R2 may include a fifth antenna element 524, a sixth antenna element 524-1, a seventh antenna element 524-2, and an eighth antenna element 524-3, which are spaced apart in a longitudinal direction of the antenna structure 520. Each of these antenna elements 524, 524-1, 524-2, and 524-3 may include a pair of conductive patterns having a length in the direction from the first side surface 5231 to the third side surface 5233 and disposed to face each other. Each of these antenna elements 524, 524-1, 524-2, and 524-3 may include a dipole antenna radiator. Each of these antenna elements 524, 524-1, 524-2, and 524-3 may be implemented in the form of a conductive via disposed in a structure of a dielectric material. Each of the plurality of antenna elements 524, 524-1, 524-2, and 524-3 may include a pair of conductive patterns attached to or formed on the third surface 521 and/or the fourth surface 522 of the antenna structure 520.

When the antenna structure 520 is combined with the PCB 510, the plurality of antenna elements 524, 524-1, 524-2, and 524-3 of the second antenna array R2 may be electrically connected to the wireless communication circuit 590 disposed on the PCB 510.

Although it is described hereinafter that the fifth antenna element 524 of the second antenna array R2 is electrically connected to the wireless communication circuit 590 through the PCB 510, the present disclosure is not limited thereto. The other antenna elements 524-1, 524-2, and 524-3 may also have substantially the same electrical connection configuration as that of the fifth antenna element 524.

The PCB 510 may include first conductive contacts 5111 disposed near and exposed to the first surface 511 and electrically connected to the wireless communication circuit 590 inside the PCB 510. The antenna structure 520 may include second conductive contacts 5241 disposed near and exposed to the first side surface 5231 and electrically connected to the fifth antenna element 524. Therefore, when the antenna structure 520 is combined with the PCB 510, the second conductive contacts 5241 may face, and be electrically connected to, the first conductive contacts 5111 of the PCB 510. The first conductive contact 5111 and the second conductive contact 5241 may be directly connected or capacitively coupled to each other.

The second antenna array R2 may be electrically connected to the wireless communication circuit 590 disposed on the first surface 511 of the PCB 510 through the second conductive contacts 5241 disposed in the antenna structure 520 and the first conductive contacts 5111 disposed on the PCB 510. In this case, the wireless communication circuit 590 may be configured to transmit and/or receive a signal having a frequency between about 3 GHz and 100 GHz through the second antenna array R2. The antenna structure 520 may further include a third antenna array including a plurality of conductive patches disposed on the third and fourth surfaces 521 and 522 so that the antenna elements 524, 524-1, 524-2, and 524-3 of the second antenna array R2 are interposed between the conductive patches. In this case, the antenna elements 524, 524-1, 524-2, and 524-3 of the second antenna array R2 may form horizontal polarization, and the conductive patches of the third antenna array may form vertical polarization, so that the antenna structure 520 may operate as a dual polarized antenna. The first side surface 5231 of the antenna structure 520 may be fixedly combined with the first surface 511 of the PCB 510 via soldering, bonding, or mechanical coupling.

Figure 5D:
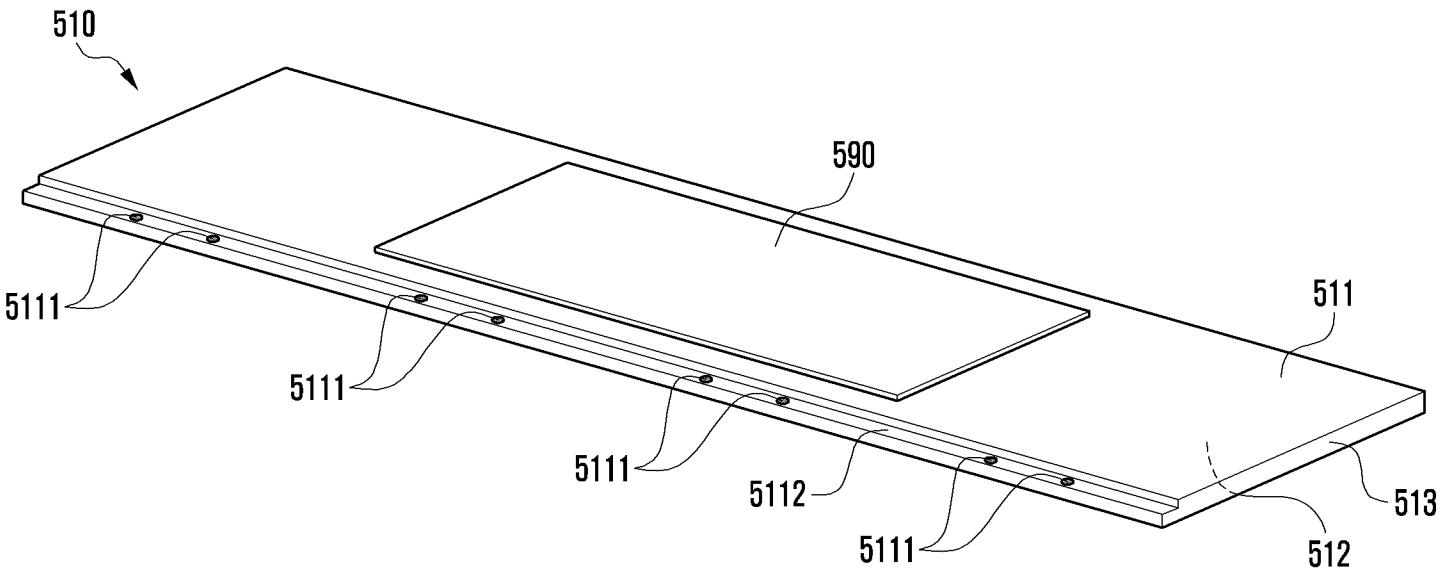
FIG. 5D is a perspective view of a PCB according to an embodiment.

FIG. 5D is a perspective view of a PCB 510.

Referring to FIG. 5D, the PCB 510 may include a recess 5112 obtained by partially removing the first surface 511. The recess 5112 of the PCB 510 permits the antenna structure 520 to be easily placed on and reliably arranged to the PCB 510 in a process of combining the antenna structure 520 with the PCB 510. The first conductive contacts 5111 may be disposed in the recess 5112.

The antenna module 500 may be configured to form a beam pattern in the second direction through the first antenna array R1 and also form a beam pattern in the first direction opposite to the second direction through the second antenna array R2. When the antenna module 500 exists at a position that is not influenced by a nearby conductive member (e.g., a conductive lateral member), at least part of the beam pattern generated from the second antenna array R2 may be formed in a third direction perpendicular to the first direction.

The antenna module 500 is capable of forming beam patterns in directions substantially opposite to each other through an orthogonal arrangement structure between the first antenna array R1 and the second antenna array R2. It is therefore possible to secure an efficient mounting space inside the electronic device (e.g., the electronic device 300 in FIG. 3A). In addition, simultaneously forming the beam patterns in both opposite directions of front and rear plates (e.g., the front plate 302 in FIG. 3A and the rear plate 311 in FIG. 3B) of the electronic device is helpful to expand beam coverage. The orthogonal arrangement structure between the PCB 510 including the first antenna array R1 and the antenna structure 520 including the second antenna array R2 may allow the antenna module 500 to be disposed using an edge a device substrate (e.g., a main board, the PCB 324 in FIG. 3C) disposed inside the electronic device. This indicates that the antenna module 500 can be disposed closer to the end of the electronic device to avoid interference of surrounding electronic components, thereby being helpful in securing the mounting space of the antenna module and improving the radiation performance.

Although the first antenna array R1 including four antenna elements 514, 514-1, 514-2, and 514-3, and the second antenna array R2 including four antenna elements 524, 524-1, 524-2, and 524-3 are described above, the present disclosure is not limited thereto. Three or less or five or more antenna elements may be used for the first antenna array and/or the second antenna array. In addition, the first antenna array R1 may be omitted.

The antenna structure 520 may include an interposer for electrical connection with another PCB that is spaced apart from the PCB 510. The antenna structure including the second antenna array may include an interposer for electrically connecting a PCB having no first antenna array to another PCB. In this case, the wireless communication circuit may be disposed on one of both PCBs.

Figure 6:
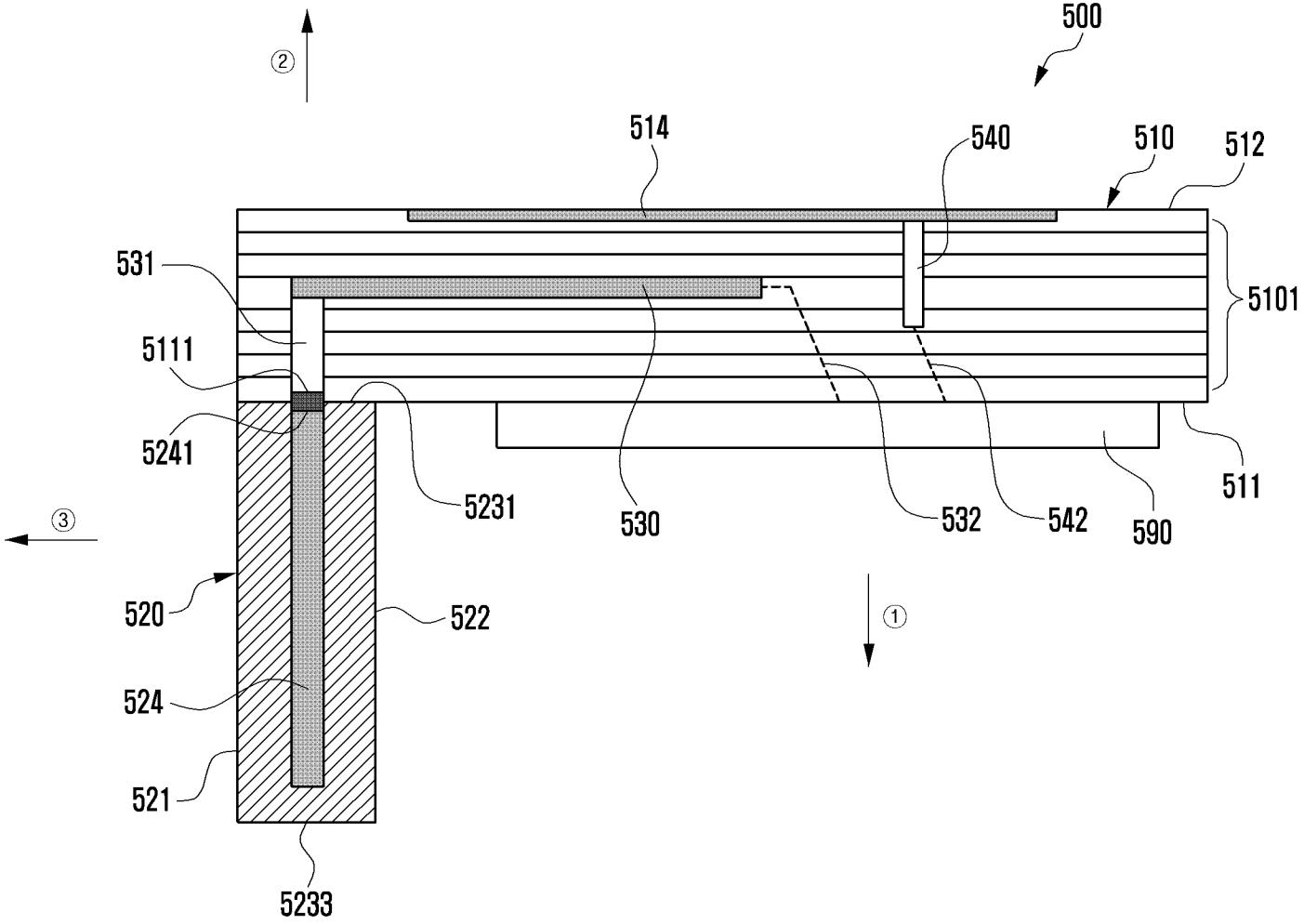
FIG. 6 is a cross-sectional view taken along the line 6-6 in FIG. 5B according to an embodiment.

FIG. 6 is a cross-sectional view taken along the line 6-6 in FIG. 5B.

Referring to FIG. 6, hereinafter, for convenience of explanation, the first antenna element 514 disposed on the PCB 510 and the fifth antenna element 524 disposed on the antenna structure 520 will be described as components electrically connected to the wireless communication circuit 590. However, the present disclosure is not limited thereto. The arrangement and electrical connection structure of the remaining antenna elements 514-1, 514-2, 514-3, 524-1, 524-2, and 524-3 may also be substantially the same.

The antenna module 500 may include the PCB 510 and the antenna structure 520 disposed substantially perpendicular to the PCB 510. The PCB 510 may include a dielectric 5101 formed of a plurality of insulating layers. The PCB 510 may include the first antenna element 514 disposed through one of the plurality of insulating layers. The first antenna element 514 may be exposed to the second surface 512 of the PCB 510 or disposed near the second surface 512. The PCB 510 may include the wireless communication circuit 590 disposed through the first surface 511. The first antenna element 514 may be electrically connected to the wireless communication circuit 590 via a first feeder 540 and a first transmission line 542 both of which are disposed in the PCB 510. The first feeder 540 may include a conductive via formed to vertically penetrate at least one insulating layer.

The antenna structure 520 may be disposed and secured to the first surface 511 of the PCB 510. In this case, the antenna structure 520 may be disposed such that the third surface 521 is perpendicular to the first surface 511 of the PCB 510. The antenna structure 520 may be disposed in such a manner that the first side surface 5231 of the antenna structure 520 is in contact with the first surface 511 of the PCB 510. Thus, the first conductive contact 5111 disposed to be exposed to the first surface 511 of the PCB 510 may be electrically connected to the second conductive contact 5241 disposed to be exposed to the first side surface 5231 of the antenna structure 520. The first conductive contact 5111 may be electrically connected to a feed line 530 disposed in the PCB 510 through a second feeder 531. The second feeder 531 may include a conductive via formed to vertically penetrate at least one insulating layer. The feed line 530 may be electrically connected to the wireless communication circuit 590 via a second transmission line 532 disposed in the PCB 510. The second conductive contact 5241 may be electrically connected to the fifth antenna element 524 embedded in the antenna structure 520, or the end of the fifth antenna element 524 may be formed to be exposed to the first side surface 5231. Therefore, the wireless communication circuit 590 may form a beam pattern in the second direction through the first antenna element 514 and in the first direction through the fifth antenna element 524. The wireless communication circuit 590 may form at least part of a beam pattern in the third direction perpendicular to the second direction through the fifth antenna element 524.

Figure 7:
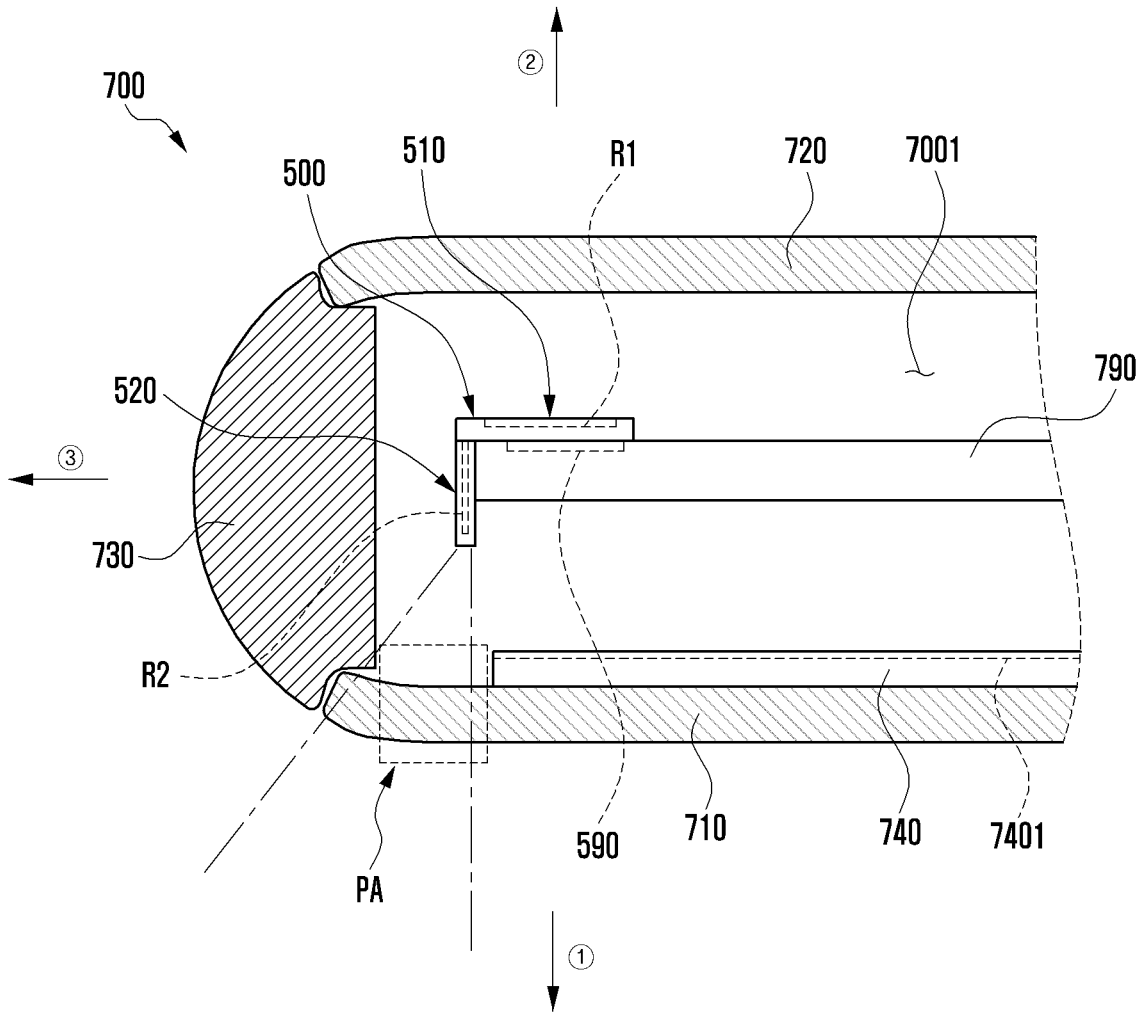
FIG. 7 is a cross-sectional view showing an electronic device including the antenna module shown in FIG. 5B according to an embodiment.

FIG. 7 is a cross-sectional view of an electronic device 700 including the antenna module 500 shown in FIG. 5B.

Referring to FIG. 7, the electronic device 700 may be similar, at least in part, to the electronic device 101 of FIG. 1 or the electronic device 300 of FIG. 3A, or may include other embodiments of the electronic device.

The electronic device 700 may include a housing (e.g., the housing 310 in FIG. 3A) that includes a first plate 710 (e.g., the front plate 302 in FIG. 3A) facing in a first direction, a second plate 720 (e.g., the rear plate 311 in FIG. 3B) facing in a second direction opposite to the first direction, and a lateral member 730 surrounding an inner space 7001 between the first plate 710 and the second plate 720. The electronic device 700 may include a display 740 (e.g., a flexible display) that is disposed in the inner space 7001 and visible to the outside through at least a portion of the first plate 710. The display 740 may include a conductive plate 7401 (e.g., a copper (Cu) plate) formed for insulation and noise shielding and having an area substantially similar to the area of the display 740. The electronic device 700 may include a peripheral area (PA) between the lateral member 730 and the display 740, and the PA may be covered with at least a portion of the first plate 710. The electronic device 700 may include a device substrate 790 (e.g., the PCB 324 in FIG. 3C) disposed in the inner space 7001.

The electronic device 700 may include the antenna module 500 disposed using the edge of the device substrate 790. The antenna module 500 may be disposed on the device substrate 790 such that the first antenna array R1 forms a beam pattern in the second direction and the second antenna array R2 forms a beam pattern in the first direction. In particular, the antenna structure 520 is disposed at a position overlapped with the PA existing out of the display 740 when the first plate 710 is viewed from above, so that the beam pattern formed by the second antenna array R2 can be advanced in the first direction through the PA. When at least a portion of the lateral member 730 is formed of a polymeric material rather than a conductive material, at least part of the beam pattern formed by the second antenna array R2 can be advanced in the third direction.

Figure 8A:
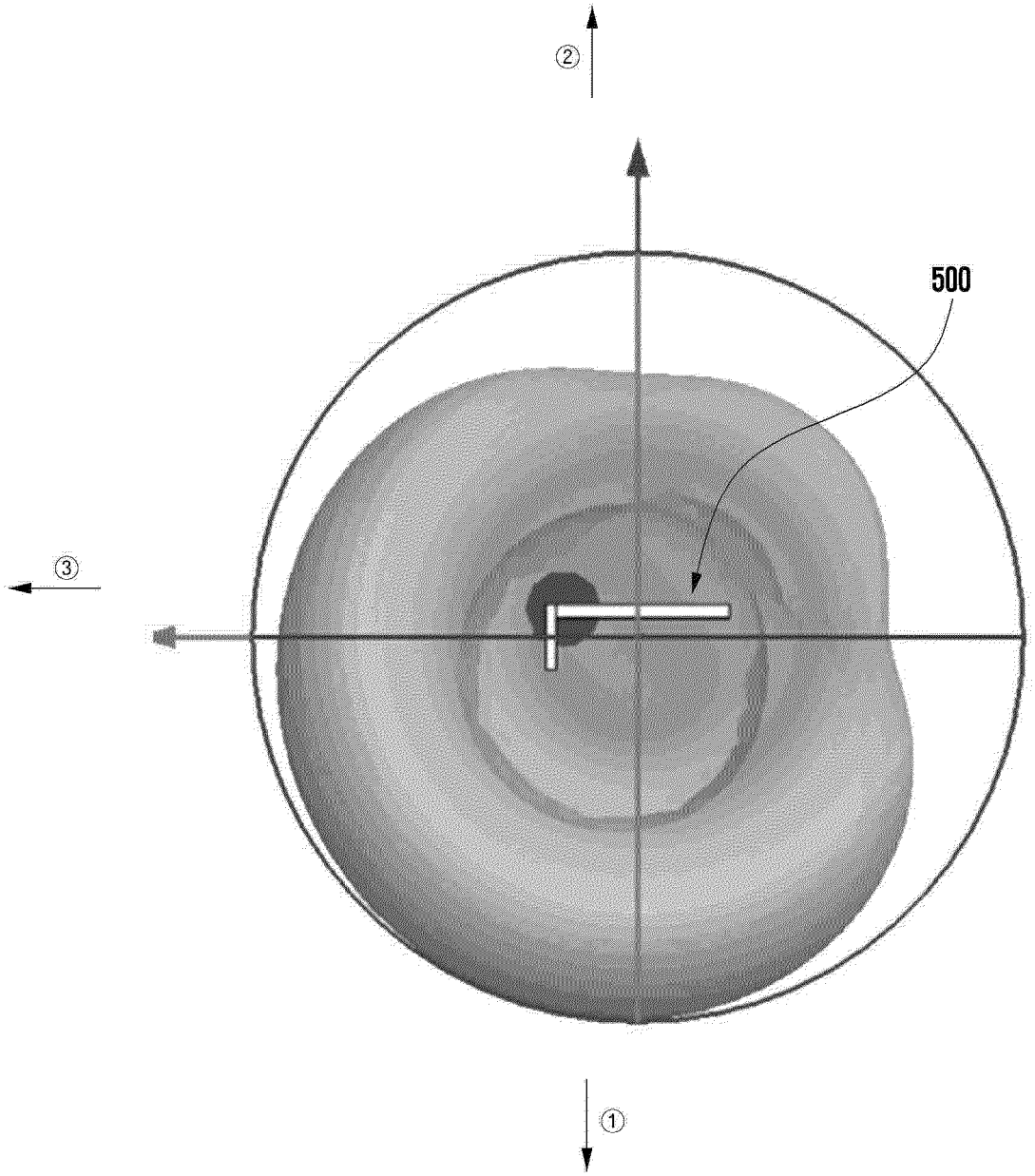
FIG. 8A is a diagram illustrating a radiation pattern of the antenna module shown in FIG. 5A according to an embodiment.

FIG. 8A is a diagram of a radiation pattern of the antenna module 500 shown in FIG. 5A.

Referring to FIG. 8A, the beam pattern is formed substantially in the first direction (i.e., in the front direction of the electronic device), at least partially in the third direction (i.e., in the lateral direction of the electronic device), by the antenna structure 520 including the second antenna array R2 perpendicular to the PCB 510.

Figure 8B:
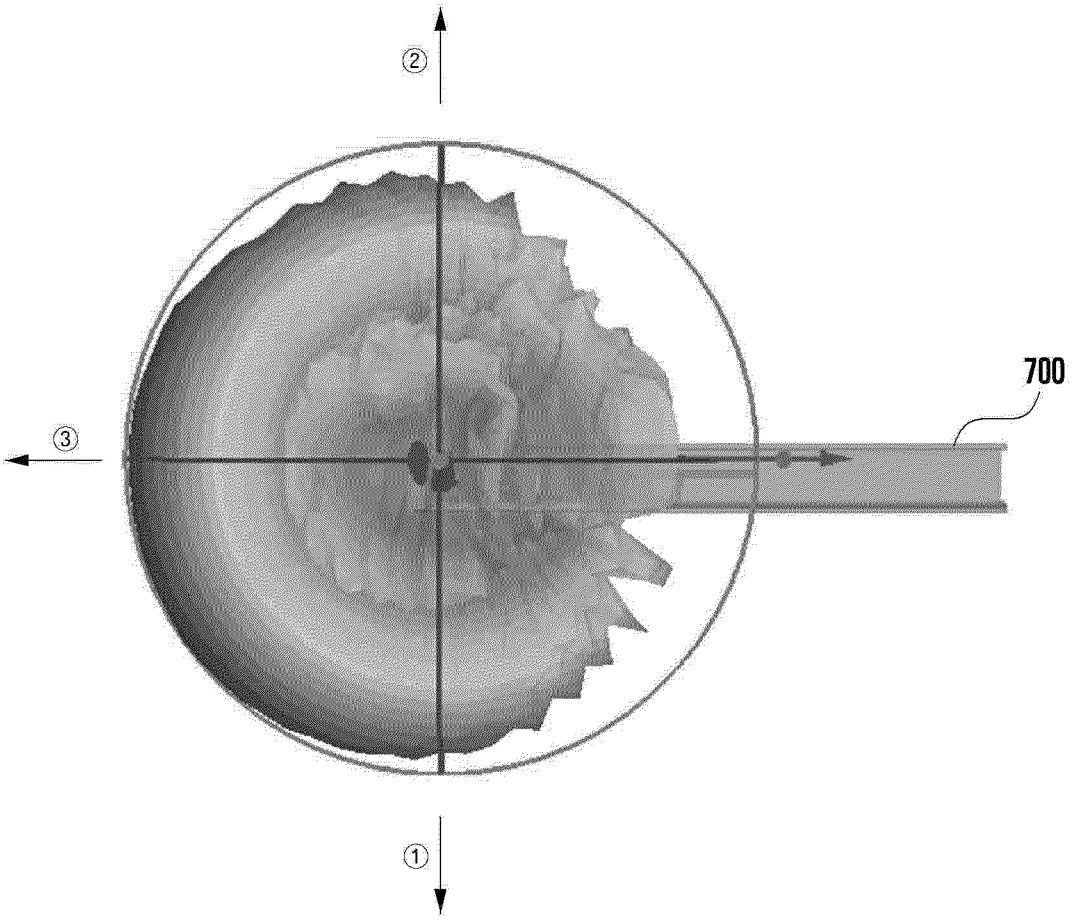
FIG. 8B is a diagram illustrating a radiation pattern of the antenna module shown in FIG. 7 according to an embodiment.

FIG. 8B is a diagram of a radiation pattern of the antenna module 500 shown in FIG. 7.

Referring to FIG. 8B, the beam coverage is expanded to the first, second, and third directions of the electronic device 700.

Figure 9A:
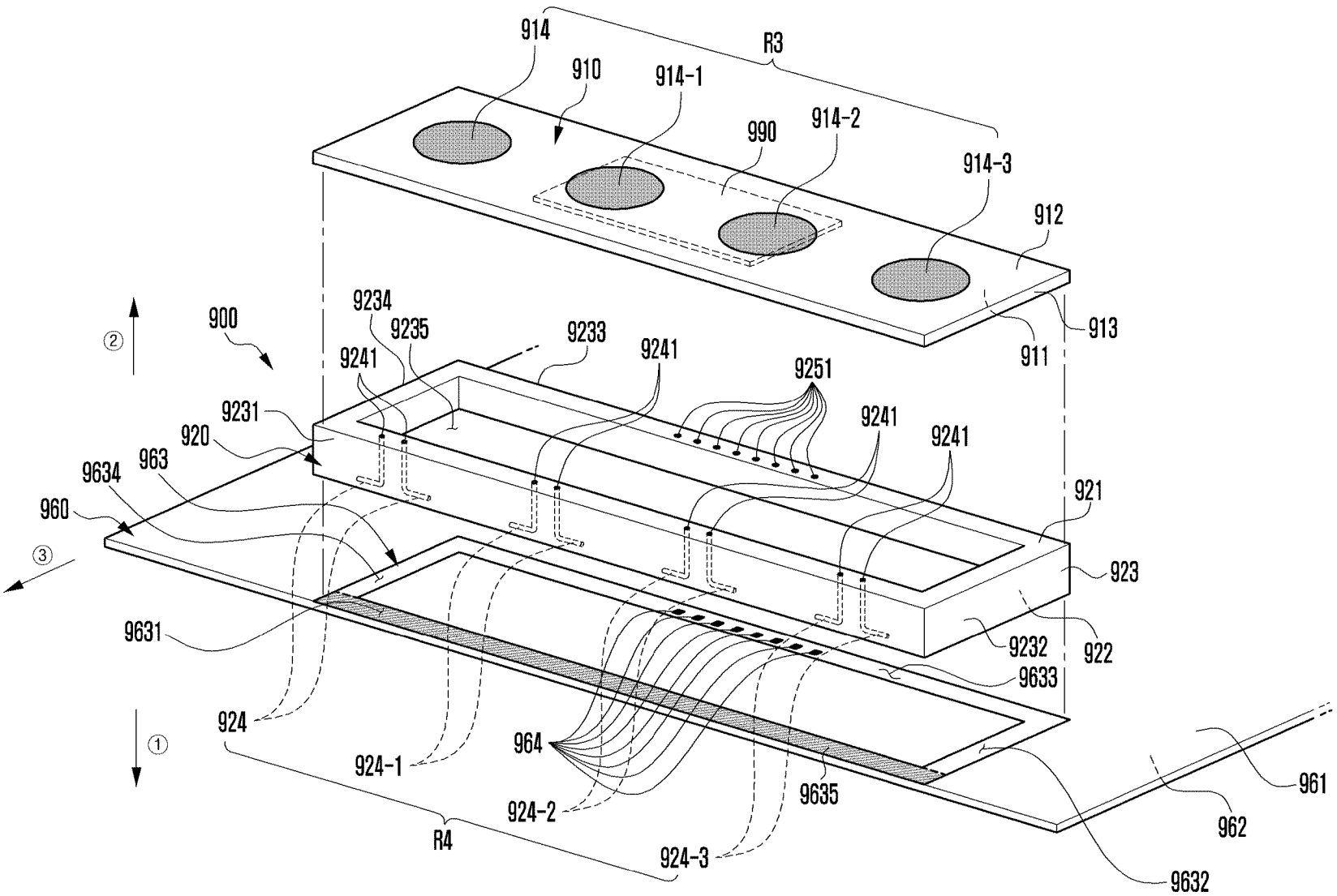
FIG. 9A is a perspective view of a separated state of an antenna module according to according to an embodiment.
Figure 9B:
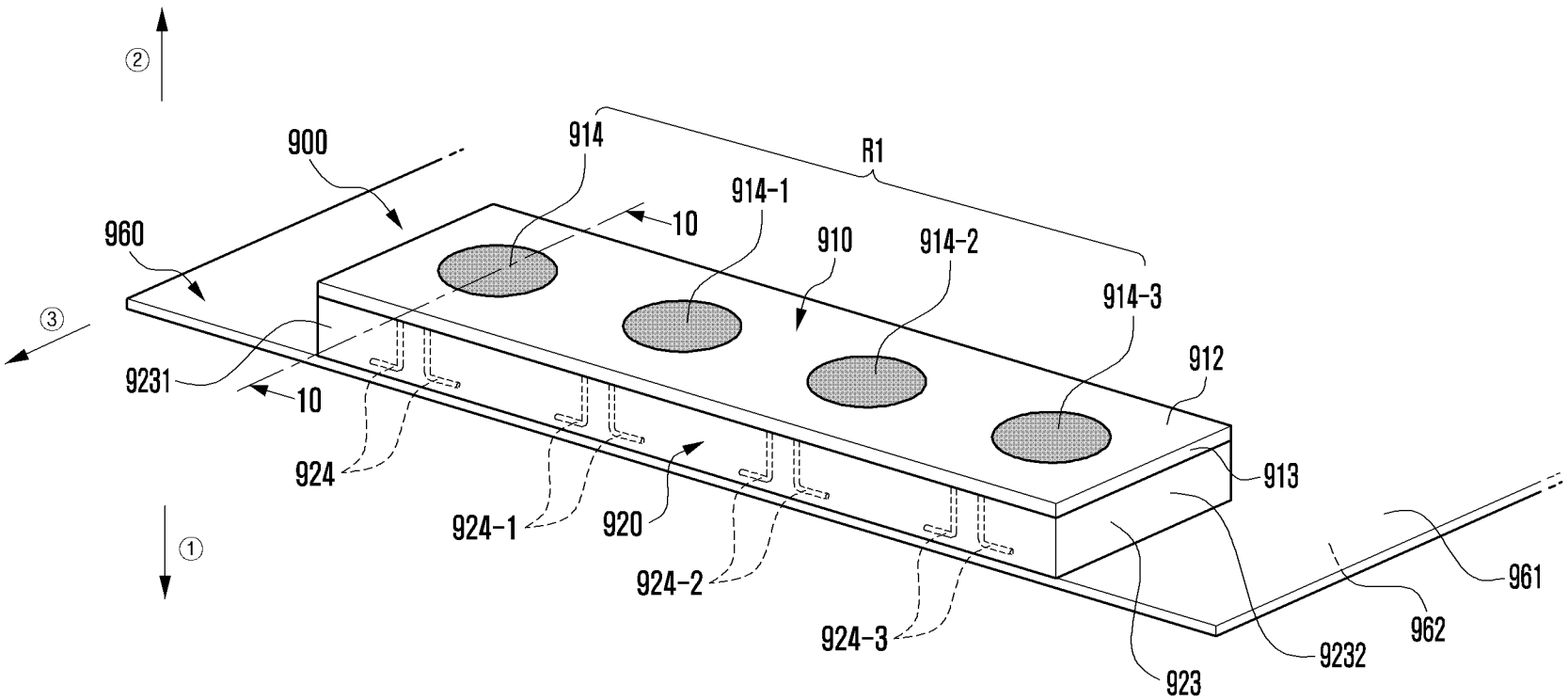
FIG. 9B is a perspective view of a combined state of the antenna module shown in FIG. 9A according to an embodiment.
Figure 9C:
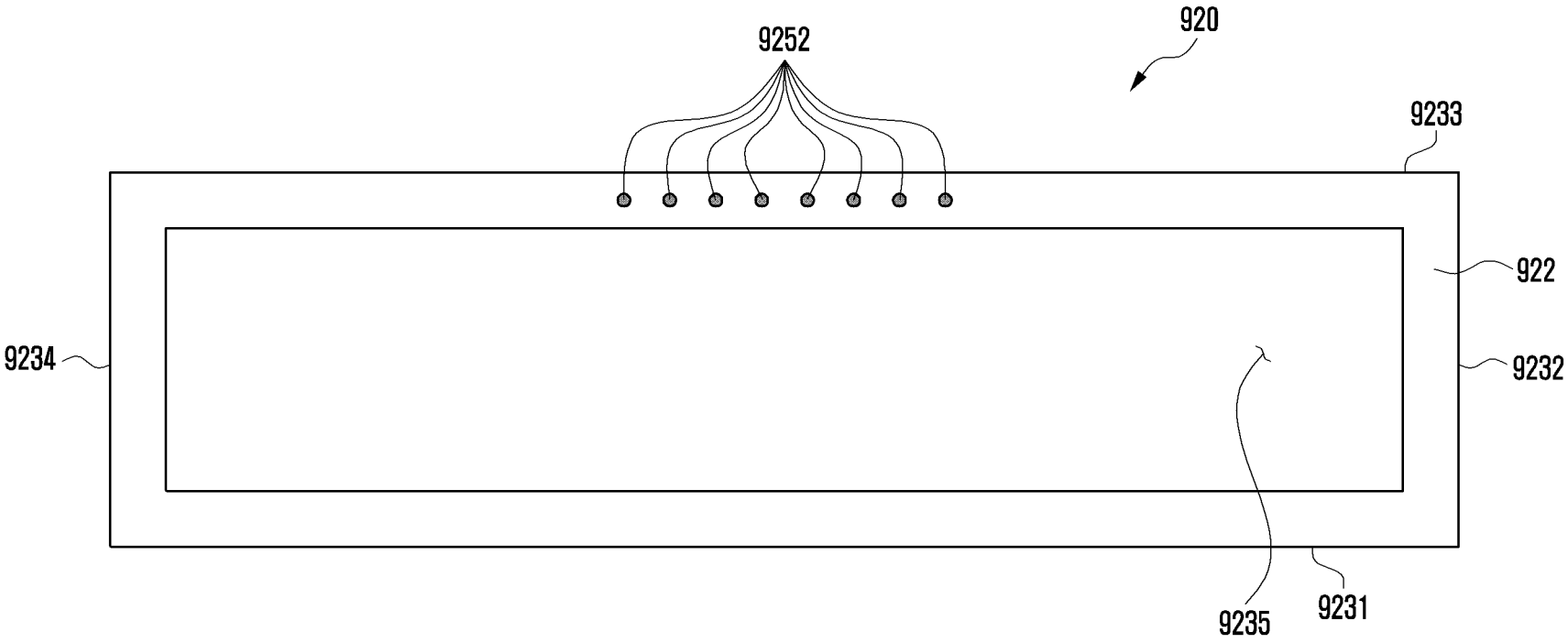
FIG. 9C is a diagram of an antenna structure of the antenna module shown in FIG. 9A according to an embodiment.

FIG. 9A is a perspective view of a separated state of an antenna module 900 according to an embodiment. FIG. 9B is a perspective view of a combined state of the antenna module 900 shown in FIG. 9A. FIG. 9C is a diagram of an antenna structure 920 of the antenna module 900 shown in FIG. 9A.

Referring to FIGS. 9A, 9B, and 9C, the antenna module 900 of FIG. 9A may be similar, at least in part, to the third antenna module 246 of FIG. 2, or may include other embodiments of the antenna module 900.

The antenna module 900 may include a PCB 910, an antenna structure 920 disposed under the PCB 910, and a device substrate 960 on which the antenna structure 920 is mounted. The PCB 910 may include a first surface 911 facing a first direction (e.g., the z direction in FIG. 3A), a second surface 912 opposite to the first surface 911 and facing a second direction (e.g., the −z direction in FIG. 3A), and a side surface 913 surrounding a space between the first surface 911 and the second surface 912. The PCB 910 may include a first antenna array R3 that includes a plurality of antenna elements 914, 914-1, 914-2, and 914-3 which are disposed near or exposed through the second surface 912 within the space. The first antenna array R3 may include a first antenna element 914, a second antenna element 914-1, a third antenna element 914-2, and a fourth antenna element 914-3, which are spaced apart at regular intervals. The first antenna array R3 may include a plurality of conductive patches which are formed on the second surface 912 of the PCB 910 or near the second surface 912 within the PCB 910. The PCB 910 may include a wireless communication circuit 990 (e.g., the RFIC 452 in FIG. 4A) disposed on the first surface 911. The PCB 910 may include a power management integrated circuit (e.g., the PMIC 454 in FIG. 4A) disposed on the first surface 911. The wireless communication circuit 990 may be electrically connected to the plurality of antenna elements 914, 914-1, 914-2, and 914-3 of the first antenna array R3. The wireless communication circuit 990 may be configured to transmit and/or receive a signal having a frequency between about 3 GHz and 100 GHz through the first antenna array R3.

The antenna structure 920 may include a third surface 921 facing the first surface 911, a fourth surface 922 opposite to the third surface 921, and a side surface 923 surrounding a space between the third surface 921 and the fourth surface 922. The fourth surface 922 of the antenna structure 920 may be disposed to face the device substrate 960. The side surface 923 may include a first side surface 9231, a second side surface 9232 vertically extending from the first side surface 9231, a third side surface 9233 extending from the second side surface 9232 in parallel with the first side surface 9231, and a fourth side surface 9234 extending from the third side surface 9233 in parallel with the second side surface 9232. The antenna structure 920 may include an opening 9235 formed to pass from the third surface 921 to the further surface 922. The opening 9235 may accommodate the wireless communication circuit 990 when the PCB 910 and the antenna structure 920 are combined with each other. The opening 9235 may also accommodate at least one electronic component mounted on the device substrate 960 when the PCB 910 and the antenna structure 920 are combined with each other. The antenna structure 920 may be formed of a dielectric. In this case, the antenna structure 920 may be formed of an interposer for electrically connecting the PCB 910 and the device substrate 960. The antenna structure 920 may be formed of a dielectric substrate including a plurality of dielectric layers.

The antenna structure 920 may include a second antenna array R4 that includes a plurality of other antenna elements 924, 924-1, 924-2, and 924-3 which are disposed at least in part inside the first side surface 9231. The second antenna array R4 may include a fifth antenna element 924, a sixth antenna element 924-1, a seventh antenna element 924-2, and an eighth antenna element 924-3, which are spaced apart at regular intervals. Each of these antenna elements 924, 924-1, 924-2, and 924-3 may include a pair of conductive patterns having a length in the direction from the third surface 921 to the fourth surface 922 and disposed to face each other. Each of these antenna elements 924, 924-1, 924-2, and 924-3 may include a dipole antenna radiator. Each of these antenna elements 924, 924-1, 924-2, and 924-3 may be implemented in the form of a conductive via disposed in a structure of a dielectric material. Each of the plurality of antenna elements 924, 924-1, 924-2, and 924-3 may include a pair of conductive patterns attached to or formed on the first side surface 9231 and/or the inner wall of the opening 9245 of the antenna structure 920.

When the antenna structure 920 is combined with the PCB 910, the plurality of antenna elements 924, 924-1, 924-2, and 924-3 of the second antenna array R4 may be electrically connected to the wireless communication circuit 990 disposed on the PCB 910.

Although it is described hereinafter that the fifth antenna element 924 of the second antenna array R4 is electrically connected to the wireless communication circuit 990 through the PCB 910, the present disclosure is not limited thereto. The other antenna elements 924-1, 924-2, and 924-3 may also have the substantially same electrical connection configuration as that of the fifth antenna element 924.

The PCB 910 may include first conductive contacts (e.g., the first conductive contacts 9111 in FIG. 10) disposed near and exposed to the first surface 911 and electrically connected to the wireless communication circuit 990 inside the PCB 910. The antenna structure 920 may include second conductive contacts 9241 disposed near and exposed to the third surface 921 and electrically connected to the fifth antenna element 924. Therefore, when the antenna structure 920 is combined with the PCB 910, the second conductive contacts 9241 may be electrically connected to the first conductive contacts 9111 of the PCB 910. When the antenna structure 920 is combined with the PCB 910, the fifth antenna element 924 may be electrically connected to the wireless communication circuit 990 disposed on the PCB 910 through the second conductive contacts 9241 and the first conductive contacts 9111. In this case, the wireless communication circuit 990 may be configured to transmit and/or receive a signal having a frequency between about 3 GHz and 100 GHz through the second antenna array R4. The antenna structure 920 may further include a third antenna array including a plurality of conductive patches disposed on the first side surface 9231 and the corresponding inner wall of the opening 9235 so that the antenna elements 924, 924-1, 924-2, and 924-3 of the second antenna array R4 are interposed between the conductive patches. In this case, the second antenna array R4 may form horizontal polarization, and the third antenna array may form vertical polarization, so that the antenna structure 920 may operate as a dual polarized antenna. The third surface 921 of the antenna structure 920 may be fixedly combined with the first surface 911 of the PCB 910 via soldering, bonding, or mechanical coupling.

The device substrate 960 may include a main PCB (e.g., the PCB 324 in FIG. 3C) disposed within the electronic device (e.g., the electronic device 300 in FIG. 3A). The device substrate 960 may include a fifth surface 961 facing the fourth surface 922 of the antenna structure 920 and a sixth surface 962 facing away from the fifth surface 961. The device substrate 960 may include, on the fifth surface 961, a structure placement area 963 in which the antenna structure 920 is disposed. The structure placement area 963 may include a first area 9631 facing a corresponding area of the fourth surface 922 extending from the first side surface 9231 of the antenna structure 920, a second area 9632 facing a corresponding area of the fourth surface 922 extending from the second side surface 9232, a third area 9633 facing a corresponding area of the fourth surface 922 extending from the third side surface 9233, and a fourth area 9634 facing a corresponding area of the fourth surface 922 extending from the fourth side surface 9234.

The PCB 910 may be electrically connected to the device substrate 960 through the antenna structure 920 interposed therebetween. The antenna structure 920 may include a conductive via (e.g., the conductive via 925 in FIG. 10) embedded in the third side surface 9233. The antenna structure 920 may include a fourth conductive contact 9251 electrically connected to one end of the conductive via 925, exposed to the third surface 921, and electrically connected to a third conductive contact (e.g., the third conductive contact 9112 in FIG. 10) disposed in and exposed to the first surface 911 of the PCB 910. The antenna structure 920 may include a fifth conductive contact 9252 electrically connected to the other end of the conductive via 925 and exposed to the fourth surface 922. When the antenna structure 920 is disposed on the device substrate 960, the fifth conductive contact 9252 may be electrically connected to a sixth conductive contact 964 disposed in and exposed to the third area 9633 of the device substrate 960. When the antenna module 900 is assembled, the wireless communication circuit 990 of the PCB 910 may be electrically connected to the device substrate 960 through the third conductive contact (e.g., the third conductive contact 9112 in FIG. 10), the fourth conductive contact 9251 of the antenna structure 920, the conductive via (e.g., the conductive via 925 in FIG. 10), the fifth conductive contact 9252, and the sixth conductive contact 964 of the device substrate 960. The fourth conductive contact 9251 of the antenna structure 920, the conductive via (e.g., the conductive via 925 in FIG. 10), and the fifth conductive contact 9252 may be used for various electrical connections between the PCB 910 and the device substrate 960.

When the antenna structure 920 is disposed on the device substrate 960, the corresponding area(s) of the fourth surface 922 extending from the second side surface 9232 and/or the fourth side surface 9234 may be fixed to the second area 9632 and/or the fourth area 9634 of the device substrate 960 through soldering, bonding, or mechanical coupling. This is for avoiding the second antenna array R4 formed in the first side surface 9231 and the conductive via (e.g., the conductive via 925 in FIG. 10) formed in the third side surface 9233. When the second antenna array R4 and the conductive via (e.g., the conductive via 925 in FIG. 10) are formed in the second side surface 9232 and the fourth side surface 9234, respectively, the antenna structure 920 may be fixed, at the corresponding area(s) of the fourth surface 922 extending from the first side surface 9231 and/or the third side surface 9233, to the first area 9631 and/or the third area 9633 of the device substrate 960.

Although the first antenna array R3 including four antenna elements 914, 914-1, 914-2, and 914-3, and the second antenna array R4 including four antenna elements 924, 924-1, 924-2, and 924-3 are described above, the present disclosure is not limited thereto. Three or less or five or more antenna elements may be used for the first antenna array and/or the second antenna array. In addition, the first antenna array R3 may be omitted.

Figure 10:
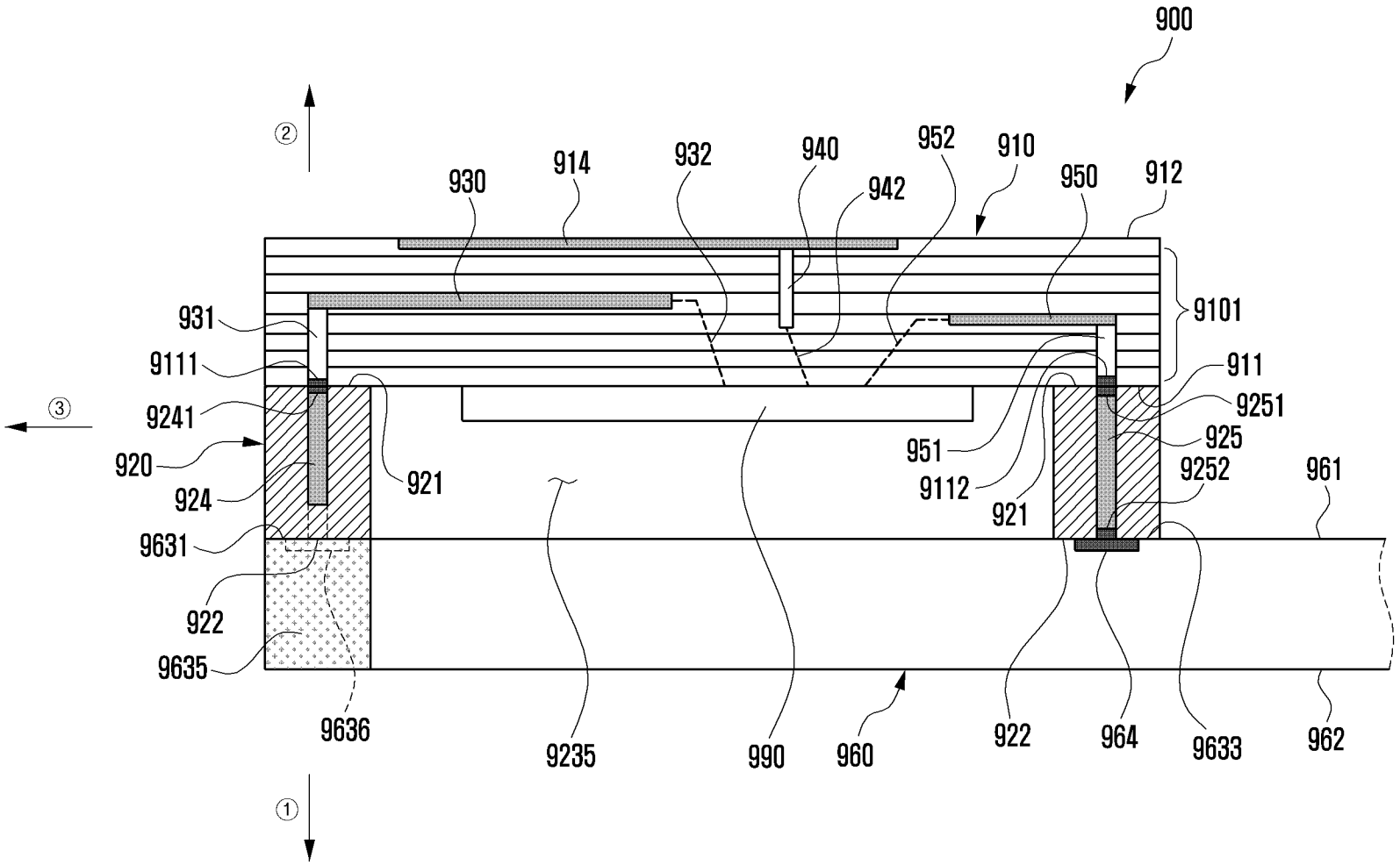
FIG. 10 is a cross-sectional view taken along the line 10-10 in FIG. 9B according to an embodiment.

FIG. 10 is a cross-sectional view taken along the line 10-10 in FIG. 9B according to an embodiment.

Referring to FIG. 10, the first antenna element 914 disposed on the PCB 910 and the fifth antenna element 924 disposed on the antenna structure 920 is described below as components electrically connected to the wireless communication circuit 990. However, the present disclosure is not limited thereto. The arrangement and electrical connection structure of the remaining antenna elements 914-1, 914-2, 914-3, 924-1, 924-2, and 924-3 may also be substantially the same.

The antenna module 900 may include the PCB 910, the antenna structure 920 disposed under the PCB 910, and the device substrate 960 on which the antenna structure 920 is mounted. The PCB 910 may include a dielectric 9101 formed of a plurality of insulating layers. The PCB 910 may include the first antenna element 914 disposed through one of the plurality of insulating layers. The first antenna element 914 may be exposed to the second surface 912 of the PCB 910 or disposed near the second surface 912. The PCB 910 may include the wireless communication circuit 990 disposed through the first surface 911. The wireless communication circuit 990 may be accommodated in the opening 9235 of the antenna structure 920. The first antenna element 914 may be electrically connected to the wireless communication circuit 990 via a first feeder 940 and a first transmission line 942 both of which are disposed in the PCB 910. The first feeder 940 may include a conductive via formed to vertically penetrate at least one insulating layer.

The antenna structure 920 may be disposed such that the third surface 921 faces the first surface 911 of the PCB 910 and the fourth surface 922 faces the fifth surface 961 of the device substrate 960. In this case, the first conductive contact 9111 disposed to be exposed to the first surface 911 of the PCB 910 may be electrically connected to the second conductive contact 9241 disposed to be exposed to the third surface 921 of the antenna structure 920. The first conductive contact 9111 may be electrically connected to a feed line 930 disposed in the PCB 910 through a second feeder 931. The second feeder 931 may include a conductive via formed to vertically penetrate at least one insulating layer. The feed line 930 may be electrically connected to the wireless communication circuit 990 via a second transmission line 932 disposed in the PCB 910. The second conductive contact 9241 may be electrically connected to the fifth antenna element 924 embedded in the antenna structure 920, or the end of the fifth antenna element 924 may be formed to be exposed to the third surface 921. Therefore, the wireless communication circuit 990 may form a beam pattern in the second direction through the first antenna element 914 and also form a beam pattern in the first direction through the fifth antenna element 924. When the first surface 911 is viewed from above, the first area 9631 of the device substrate 960 overlapped with the fifth antenna element 924 may be formed of a nonconductive material 9635 for forming a beam pattern. The wireless communication circuit 990 may form at least part of a beam pattern in the third direction perpendicular to the second direction through the fifth antenna element 924.

The wireless communication circuit 990 may be electrically connected to the device substrate 960 through the antenna structure 920. The PCB 910 may include a conductive line 950 having a certain length in the insulating layer. One end of the conductive line 950 may be electrically connected to the wireless communication circuit 990 via a third transmission line 952, and the other end may be electrically connected to a transfer portion 951 connected to the third conductive contact 9112. The transfer portion 951 may include a conductive via disposed to vertically penetrate at least one insulating layer. Therefore, the wireless communication circuit 990 may be electrically connected to the device substrate 960 via the third transmission line 952, the conductive line 950, the transfer portion 951, and the third conductive contact 9112 in the PCB 910, via the fourth conductive contact 9251 exposed on the third surface 921, the conductive via 925, and the fifth conductive contact 9252 exposed to the fourth surface 922 in the antenna structure 920, and via the sixth conductive contact 964 exposed in the third area 9633 of the fifth surface 961 in the device substrate 960.

The fifth antenna element 924 may be disposed to be exposed to the fourth surface 922 of the antenna structure 920 and may be electrically connected to an additional conductive pattern 9636 formed to be exposed to the first area 9631 of the device substrate 960. In this case, the operating frequency band or bandwidth of the second antenna array R4 may be changed (e.g., expanded) by the additional conductive pattern 9636.

Figure 11:
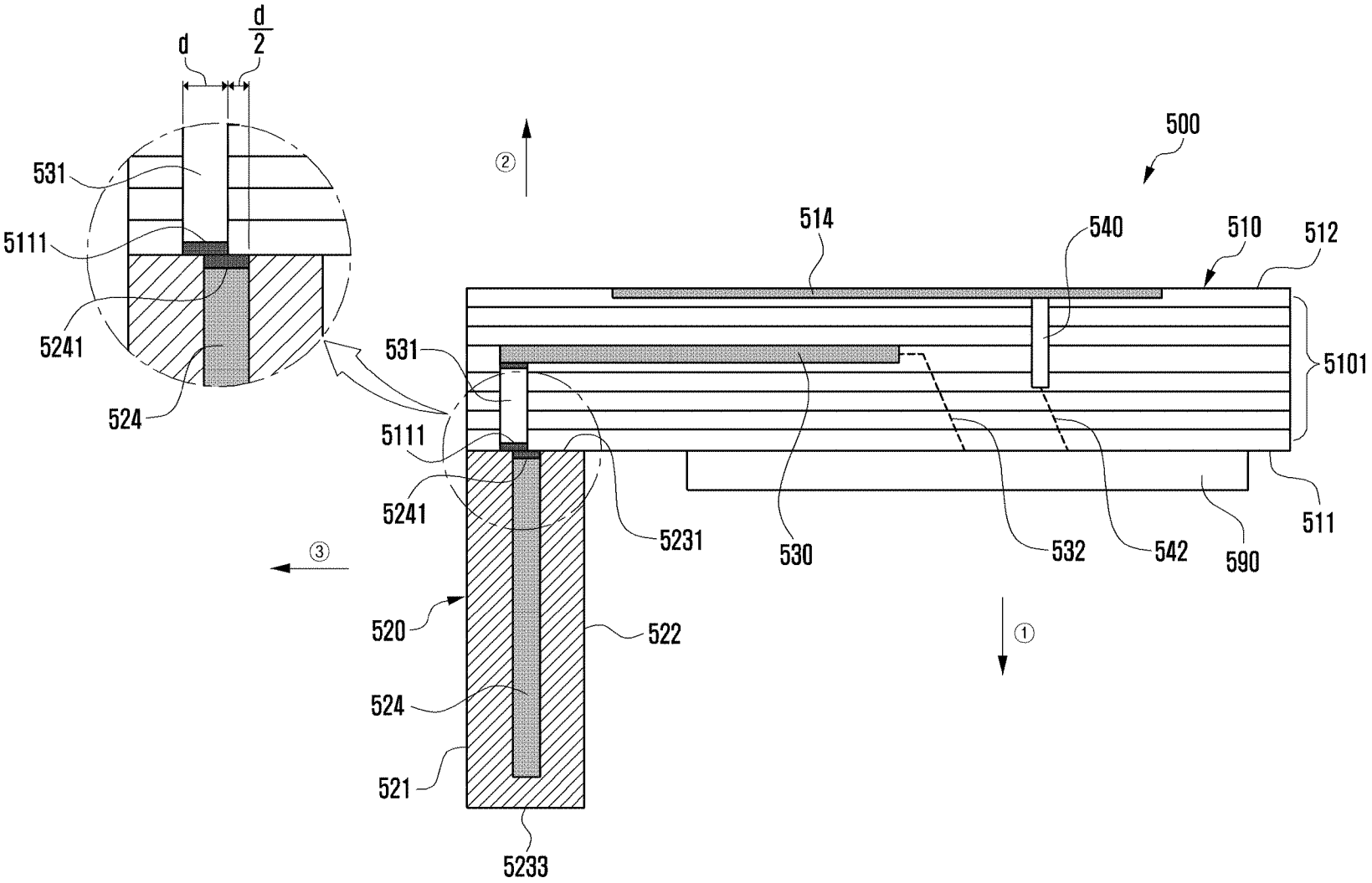
FIG. 11 is a cross-sectional view of a state in which the first and second conductive contacts shown in FIG. 6 are tilted according to an embodiment.
Figure 12:
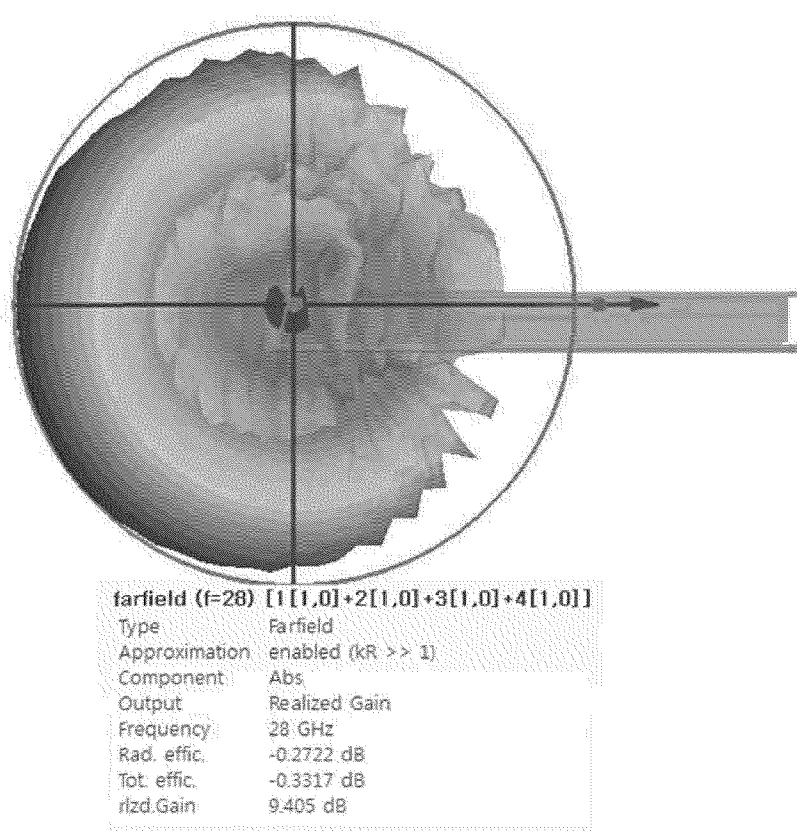
FIG. 12 is a diagram of radiation patterns of the first and second conductive contacts shown in FIG. 6 before and after a tilt according to an embodiment.
Figure 12:
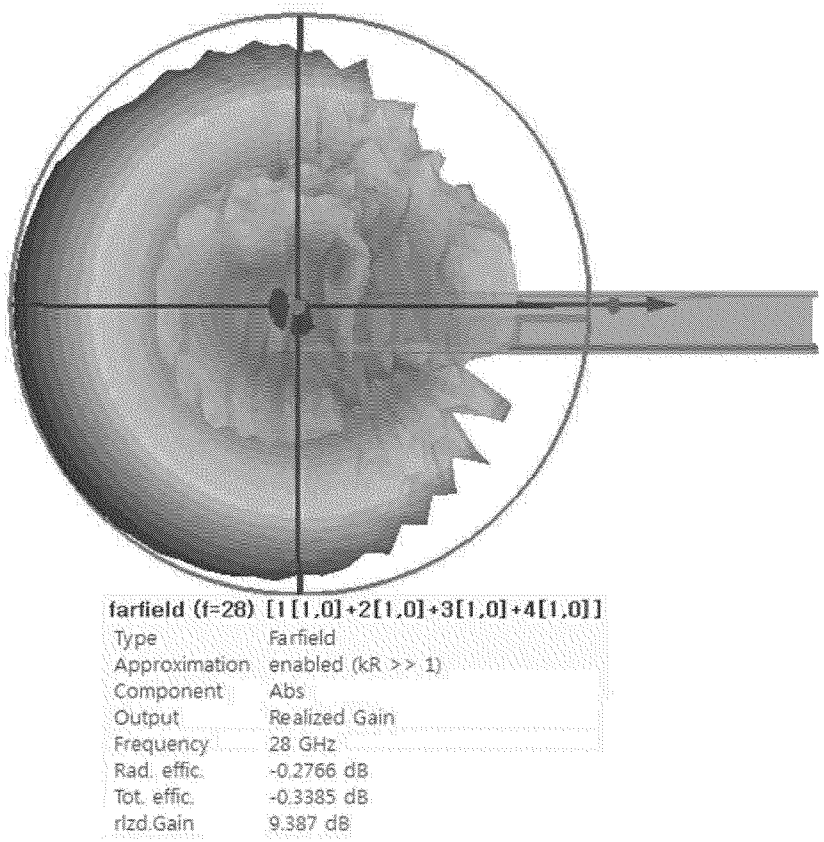

FIG. 11 is a cross-sectional view of a state in which the first and second conductive contacts 5111 and 5241 shown in FIG. 6 are tilted. FIG. 12 is a diagram of radiation patterns of the first and second conductive contacts 5111 and 5241 before and after a tilt.

Referring to FIGS. 11 and 12, the configuration shown in FIG. 11 is mostly the same as that of FIG. 6, so that a detailed description of the same configuration is omitted hereinafter.

The first conductive contact 5111 exposed on the PCB 510 and the second conductive contact 5241 exposed on the antenna structure 520 may be sometimes tilted with respect to each other due to an assembly error. Even if the first conductive contact 5111 is tilted (i.e., mismatched) up to 50% (d/2) of the entire width (d) with respect to the second conductive contact 5241, the radiation performance is not degraded as shown in FIG. 12 in comparison with a default case where the first and second conductive contacts 5111 and 5241 are correctly matched to each other.

Figure 13A:
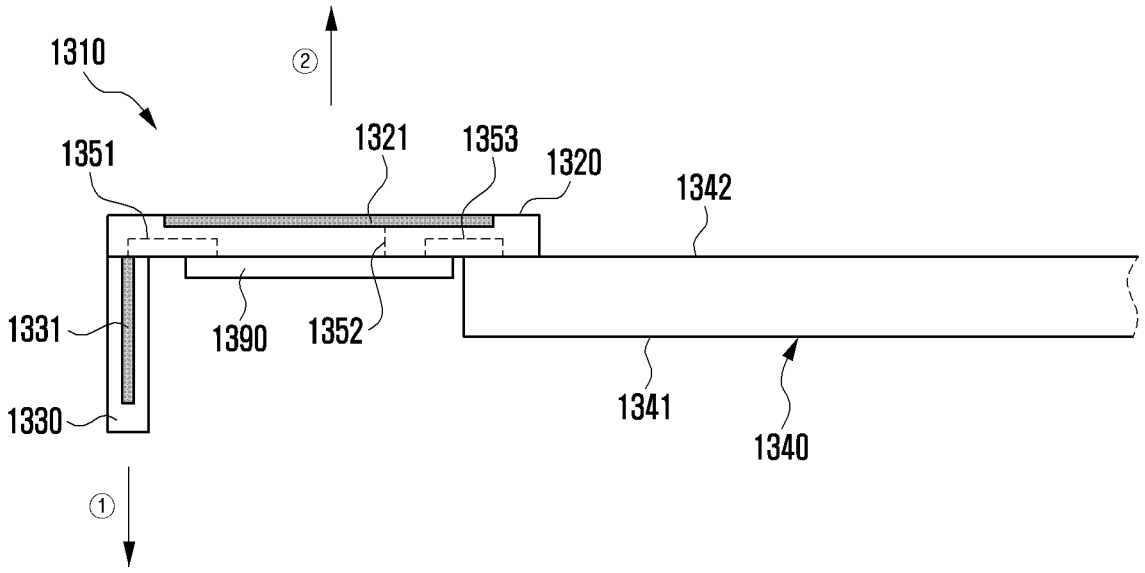
FIGS. 13A and 13B are diagrams of an arrangement relationship in antenna modules according to an embodiment.
Figure 13B:
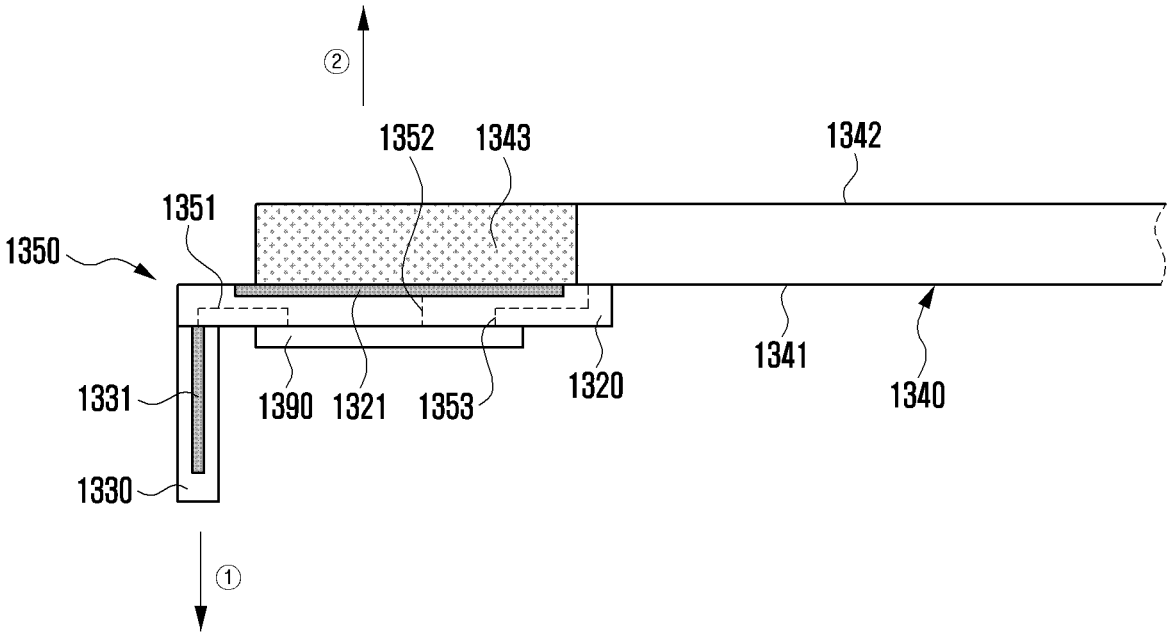

FIGS. 13A and 13B are diagrams of an arrangement relationship in antenna modules 1310 and 1350 according to an embodiment.

Referring to FIGS. 13A and 13B, each of the antenna modules 1310 and 1350 may be similar, at least in part, to the third antenna module 246 of FIG. 2, or may include other embodiments of an antenna module.

The antenna module 1310 may have a configuration similar to that of the antenna module 500 shown in FIG. 5A. The antenna module 1310 may be arranged such that at least a portion of a PCB 1320 is overlapped with a device substrate 1340 (e.g., the main substrate of the electronic device). The device substrate 1340 may include a first substrate surface 1341 facing a first direction (e.g., the z direction in FIG. 3A) and a second substrate surface 1342 facing a second direction (e.g., the −z direction in FIG. 3A).

The antenna module 1310 may include the PCB 1320 including a first antenna array 1321 (e.g., the first antenna array R1 in FIG. 5A) arranged to form a beam pattern in the second direction, and an antenna structure 1330 mounted in a direction perpendicular to the PCB 1320 and including a second antenna array 1331 (e.g., the second antenna array R2 in FIG. 5A) arranged to form a beam pattern substantially in the first direction. The first antenna array 1321 and the second antenna array 1331 may be electrically connected to a wireless communication circuit 1390 through a plurality of transmission lines 1351 and 1352 disposed inside the PCB 1320. The wireless communication circuit 1390 may be electrically connected to the device substrate 1340 via another transmission line 1353 disposed inside the PCB 1320.

In the antenna module 1310, a portion of the PCB 1320 is mounted on, and overlapped with, a portion (including an edge) of the second substrate surface 1342 of the device substrate 1340, and the antenna structure 1330 is vertically mounted at the end of the PCB 1320. This configuration is helpful for providing an efficient mounting space inside the electronic device (e.g., 300 in FIG. 3A). The PCB 1320 may be spaced apart from the device substrate 1340. In this case, a conductive cable (e.g., a flexible printed circuit board (FPCB)) may be interposed between and electrically connected to both the PCB 1320 and the device substrate 1340.

Referring to FIG. 13B, in the antenna module 1350, the PCB 1320 may be arranged to be overlapped, at least in part, with the first substrate surface 1341 of the device substrate 1340. In this case, the first antenna array 1321 is disposed between the device substrate 1340 and the wireless communication circuit 1390. Therefore, a portion of the device substrate 1340 overlapped with first antenna array 1321 when the first substrate surface 1341 is viewed from above may be formed of a nonconductive material 1343 for beam pattern formation in the second direction.

Figure 14:
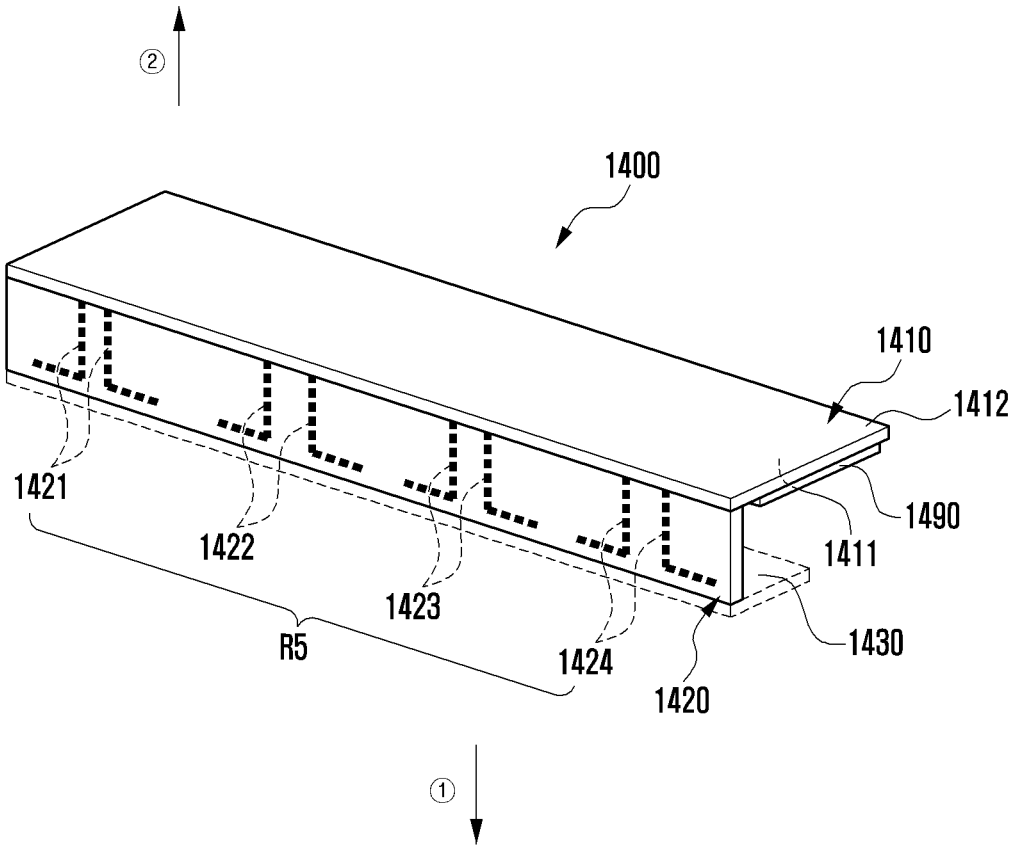
FIG. 14 is a perspective view of an antenna module according to according to an embodiment.

FIG. 14 is a perspective view of an antenna module 1400 according to an embodiment.

Referring to FIG. 14, the antenna module 1400 may be similar, at least in part, to the third antenna module 246 of FIG. 2, or may include other embodiments of an antenna module.

The antenna module 1400 may include a first PCB 1410 and an antenna structure 1420 disposed vertically from one end of the first PCB 1410. The first PCB 1410 may include a first surface 1411 facing a first direction (e.g., the z direction in FIG. 3A), and a second surface 1412 opposite to the first surface 1411 and facing a second direction (e.g., the −z direction in FIG. 3A). The first PCB 1410 may include a wireless communication circuit 1490 disposed on the first surface 1411. The wireless communication circuit 1490 may be disposed on the second surface 1412.

The antenna structure 1420 may include an antenna array R5 that includes a plurality of antenna elements 1421, 1422, 1423, and 1424. The antenna array R5 may include a first antenna element 1421, a second antenna element 1422, a third antenna element 1423, and a fourth antenna element 1424, which are spaced apart at regular intervals in a longitudinal direction of the antenna structure 1420. The antenna array R5 may be electrically connected to the wireless communication circuit 1490 disposed on the first PCB 1410 via a transmission line and conductive contacts as described above. The wireless communication circuit 1490 may be configured to transmit and/or receive a signal having a frequency between about 3 GHz and 100 GHz through the antenna array R5. The antenna module 1400 may be configured to adjust the direction of a beam pattern of the antenna array R5 or secure the beam coverage having a specific scanning range through a phase shifter disposed in an RF chain in which the antenna elements 1421, 1422, 1423, and 1424 are electrically connected to the wireless communication circuit 1490.

The antenna module 1400 may include a second PCB 1430 disposed to face the first PCB 1410 with the antenna structure 1420 interposed therebetween. In this case, the second PCB 1430 may be electrically connected to the first PCB 1410 by the antenna structure 1420 performing an interposer function. For example, the antenna structure 1420 may be used as a radiator for forming a beam pattern in a designated radial direction through the antenna array R5, and also provide an electrical connection structure between the first PCB 1410 and the second PCB 1430.

As described above, the antenna module of the present disclosure provides an efficient mounting space in the electronic device through a change in arrangement of the antenna elements. This may contribute to the slimming of the electronic device. In addition, the antenna module of the present disclosure is capable of forming beam patterns in opposite directions, thereby securing the beam coverage in various directions.

According to an embodiment, an electronic device (e.g., the electronic device 300 in FIG. 3A) may include a housing (e.g., the housing 310 in FIG. 3A), a PCB (e.g., the PCB 510 in FIG. 5A), an antenna structure (e.g., the antenna structure 520 in FIG. 5A), and a display (e.g., the display 301 in FIG. 3A). The housing may include a first plate (e.g., the front plate 302 in FIG. 3A) facing a first direction (e.g., the z direction in FIG. 3A), a second plate (e.g., the rear plate 311 in FIG. 3B) facing a second direction (e.g., the −z direction in FIG. 3A) opposite to the first direction, and a lateral member (e.g., the lateral bezel structure 318 in FIG. 3A) surrounding a space between the first plate and the second plate. The PCB may be disposed in an inner space of the housing and may include at least one first conductive contact (e.g., the first conductive contact 5111 in FIG. 5C) exposed at least partially and electrically connected to a wireless communication circuit (e.g., the wireless communication circuit 590 in FIG. 5A). The antenna structure may be disposed on the PCB, include at least one first antenna element (e.g., the second antenna array R2; 524, 524-1, 524-2, and 524-3), and include at least one second conductive contact (e.g., the second conductive contact 5241 in FIG. 5A) exposed at least partially and electrically connected to the at least one first antenna element. The at least one first conductive contact may be electrically connected to the at least one second conductive contact when the antenna structure is combined with the PCB. The wireless communication circuit may be configured to form a directional beam through the at least one first antenna element.

The wireless communication circuit may be configured to transmit and/or receive a signal having a frequency between about 3 GHz and 100 GHz through the at least one first antenna element.

The PCB may include a first surface (e.g., the first surface 511 in FIG. 5A) facing the first direction, a second surface (e.g., the second surface 512 in FIG. 5A) facing the second direction, and a side surface (e.g., the side surface 513 in FIG. 5A) surrounding a space between the first surface and the second surface. The at least one first conductive contact may be disposed to be exposed to at least a portion of the first surface of the PCB The antenna structure may include a third surface (e.g., the third surface 521 in FIG. 5A) facing the lateral member in the space, a fourth surface (e.g., the fourth surface 522 in FIG. 5A) opposite to the third surface, and a side surface (e.g., the side surface 523 in FIG. 5A) surrounding an inner space between the third surface and the fourth surface. The side surface may include a first side surface (e.g., the first side surface 5231 in FIG. 5A) facing the first surface of the PCB, a second side surface (e.g., the second side surface 5232 in FIG. 5A) extending perpendicularly from the first surface, a third side surface (e.g., the third side surface 5233 in FIG. 5A) extending from the second side surface in parallel with the first side surface, and a fourth side surface (e.g., the fourth side surface 5234 in FIG. 5A) extending from the third side surface in parallel with the second side surface. The at least one first antenna element may include a pair of conductive patterns spaced apart at regular intervals in a direction from the first side surface to the second side surface inside the inner space.

The at least one second conductive contact may be disposed to be exposed to the first side surface of the antenna structure, and the at least one first conductive contact may be electrically connected to the at least one second conductive contact when the first side surface meets the first surface.

The antenna structure may be fixed to the PCB via soldering, bonding, or mechanical coupling.

The electronic device may further include a device substrate (e.g., the device substrate 1340 in FIG. 13A) disposed substantially in parallel with the first plate (e.g., the first plate 302 in FIG. 3A) in the space. The PCB (e.g., the PCB 1320 in FIG. 13A) may be disposed between the device substrate and the second plate (e.g., the second plate 311 in FIG. 3B) or between the device substrate and a display, and overlapped with at least a portion of the device substrate when the first plate is viewed from above.

The PCB may further include at least one second antenna element (e.g., the first antenna array R1; 514, 514-1, 514-2, and 514-3) exposed through the second surface or disposed near the second surface in the space, and the wireless communication circuit may be configured to form a directional beam at least in part through the at least one second antenna element.

When the PCB is disposed between the device substrate and the display, the device substrate may include a nonconductive material (e.g., the nonconductive material 1343 in FIG. 13B) formed in an area overlapped with the at least one second antenna element (e.g., the first antenna element 1321 in FIG. 13B) when the first plate is viewed from above.

The antenna structure (e.g., the antenna structure 920 in FIG. 9A) may include a third surface (e.g., the third surface 921 in FIG. 9A) facing the second surface (e.g., the second surface 911 in FIG. 9A), a fourth surface (e.g., the fourth surface 922 in FIG. 9A) opposite to the third surface, and a side surface (e.g., the side surface 923 in FIG. 9A) surrounding an inner space between the third surface and the fourth surface. The side surface may include a first side surface (e.g., the first side surface 9231 in FIG. 9A), a second side surface (e.g., the second side surface 9232 in FIG. 9A) extending perpendicularly from the first surface, a third side surface (e.g., the third side surface 9233 in FIG. 9A) extending from the second side surface in parallel with the first side surface, and a fourth side surface (e.g., the fourth side surface 9234 in FIG. 9A) extending from the third side surface in parallel with the second side surface. The at least one first antenna element (e.g., the second antenna element 924 in FIG. 9A) may include a pair of conductive patterns spaced apart at regular intervals in a direction from the third side surface to the fourth side surface inside the inner space near the first side surface.

The at least one first conductive contact (e.g., the first conductive contact 9111 in FIG. 10) may be disposed to be exposed to at least a portion of the first surface of the PCB (e.g., the PCB 910 in FIG. 9A), and the at least one second conductive contact (e.g., the second conductive contact 9241 in FIG. 9A) may be disposed to be exposed to the third surface of the antenna structure. The at least one first conductive contact may be electrically connected to the at least one second conductive contact when the third surface meets the first surface.

The electronic device may further include a device substrate (e.g., the device substrate 960 in FIG. 9A) disposed between the antenna structure and the first plate. The device substrate may include a fifth surface (e.g., the fifth surface 961 in FIG. 9A) facing the fourth surface, and a sixth surface (e.g., the sixth surface 962 in FIG. 9A) opposite to the fifth surface. The fifth surface may have a structure placement area (e.g., the structure placement area 963 in FIG. 9A) in which the antenna structure is disposed.

The structure placement area may include a first area (e.g., the first area 9631 in FIG. 9A) facing a corresponding area of the fourth surface extending from the first side surface, a second area (e.g., the second area 9632 in FIG. 9A) facing a corresponding area of the fourth surface extending from the second side surface, a third area (e.g., the third area 9633 in FIG. 9A) facing a corresponding area of the fourth surface extending from the third side surface, and a fourth area (e.g., the fourth area 9634 in FIG. 9A) facing a corresponding area of the fourth surface extending from the fourth side surface. The first area may include a nonconductive material (e.g., the nonconductive material 9635 in FIG. 10) when the first plate is viewed from above.

The wireless communication circuit (e.g., the wireless communication circuit 990 in FIG. 9A) may be disposed on the first surface of the PCB, and the antenna structure may include an opening (e.g., the opening 9235 in FIG. 9A) for accommodating the wireless communication circuit.

The electronic device may further include an electrical connection structure for electrically connecting the wireless communication circuit to the device substrate.

The electrical connection structure may be disposed at a location opposite to the at least one first antenna element.

The antenna structure may be fixed to the device substrate and/or the PCB while avoiding an area overlapped with the electrical connection structure and/or the at least one first antenna element when the first plate is viewed from above.

The electrical connection structure may include at least one third conductive contact (e.g., the third conductive contact 9212 in FIG. 10) disposed to be exposed to the first surface (e.g., the first surface 911 in FIG. 10) of the PCB (e.g., the PCB 910 in FIG. 10) and electrically connected to the wireless communication circuit (e.g., the wireless communication circuit 990 in FIG. 10), at least one fourth conductive contact (e.g., the fourth conductive contact 9251 in FIG. 10) disposed to be exposed to the third surface (e.g., the third surface 921 in FIG. 10) from one end of a conductive via (e.g., the conductive via 925 in FIG. 10) disposed in the inner space of the antenna structure, and facing the at least one third conductive contact, at least one fifth conductive contact (e.g., the fifth conductive contact 9252 in FIG. 10) disposed to be exposed to the fourth surface from other end of the conductive via, and a sixth conductive contact (e.g., the sixth conductive contact 964 in FIG. 10) disposed at a location facing the at least one fifth conductive contact in the fifth surface of the device substrate.

The first plate (e.g., the first plate 710 in FIG. 7) may be disposed to cover a peripheral area (e.g., the PA in FIG. 7) between the display (e.g., the display 740 in FIG. 7) and the lateral member (e.g., the lateral member 730 in FIG. 7), and the at least one first antenna element (e.g., the second antenna element 524 in FIG. 7) may be disposed to be exposed at a position overlapped the peripheral are when the first plate is viewed from above.

At least a portion of the lateral member (e.g., the lateral member 730 in FIG. 7) may be formed as a nonconductive area including a nonconductive material, and the wireless communication circuit may form a beam pattern at least in a direction of the nonconductive area through the at least one first antenna element.

While the disclosure is particularly shown and described with reference to exemplary embodiments thereof, it will be understood by those skilled in the art that various changes in form and details may be made therein without departing from the scope of the disclosure as defined by the appended claims and their equivalents.

What is claimed is:

1. An electronic device, comprising:

a housing;

a wireless communication circuit;

a printed circuit board (PCB) disposed in an inner space of the housing, including a first antenna array with a first plurality of antenna elements and at least one first conductive contact at least partially and electrically connected to the wireless communication circuit, and including:

a first surface facing a first direction, and a second surface facing a second direction opposite to the first direction, wherein the at least one first conductive contact is disposed to at least a portion of the first surface of the PCB; and an antenna structure perpendicularly disposed on the PCB, including a second antenna array with a second plurality of antenna elements and at least one second conductive contact at least partially and electrically connected to the second plurality of antenna elements respectively and including:

a third surface;

a fourth surface opposite to the third surface; and a side surface surrounding a space between the third surface and the fourth surface, wherein the at least one second conductive contact is disposed to the side surface of the antenna structure, wherein the at least one first conductive contact is electrically connected to the at least one second conductive contact when the side surface meets the first surface, and wherein the wireless communication circuit is configured to form a directional beam through the first antenna array and the second antenna array.

2. The electronic device of claim 1, wherein the wireless communication circuit is further configured to transmit and/or receive a signal having a frequency between about 3 GHz and 100 GHz through the first antenna array and the second antenna array.

3. The electronic device of claim 1, wherein the housing includes a first plate having the first direction, a second plate having the second direction opposite to the first direction, and a lateral member surrounding the inner space between the first plate and the second plate.

4. The electronic device of claim 3, wherein the third surface faces the lateral member in the inner space and the fourth surface opposite to the third surface, wherein the side surface includes:

a first side surface facing the first surface of the PCB, a second side surface extending perpendicularly from the first surface, a third side surface extending from the second side surface in parallel with the first side surface, and a fourth side surface extending from the third side surface in parallel with the second side surface, and wherein the second plurality of antenna elements include conductive patterns spaced apart at regular intervals in a direction from the second side surface to the fourth side surface inside the space.

5. The electronic device of claim 4, wherein the at least one second conductive contact is disposed to the first side surface of the antenna structure, and wherein the at least one first conductive contact is further electrically connected to the at least one second conductive contact when the first side surface meets the first surface.

6. The electronic device of claim 5, wherein the antenna structure is fixed to the PCB via soldering, bonding, or mechanical coupling.

7. The electronic device of claim 3, further comprising a device substrate disposed substantially in parallel with the first plate in the inner space, wherein the PCB is disposed between the device substrate and the second plate or between the device substrate and a display, and overlapped with at least a portion of the device substrate when the first plate is viewed from above.

8. The electronic device of claim 7, wherein when the PCB is disposed between the device substrate and the display, the device substrate includes a nonconductive material formed in an area overlapped with the second antenna array when the first plate is viewed from above.

9. The electronic device of claim 3, wherein the side surface includes:

a first side surface;

a second side surface extending perpendicularly from the first surface;

a third side surface extending from the second side surface in parallel with the first side surface; and a fourth side surface extending from the third side surface in parallel with the second side surface, and wherein the second plurality of antenna elements include a pair of conductive patterns spaced apart at regular intervals in a direction from the second side surface to the fourth side surface inside the space near the first side surface.

10. The electronic device of claim 9, wherein the at least one second conductive contact is disposed to the third surface of the antenna structure, and wherein the at least one first conductive contact is further electrically connected to the at least one second conductive contact when the third surface meets the first surface.

11. The electronic device of claim 10, further comprising a device substrate disposed between the antenna structure and the first plate, wherein the device substrate includes a fifth surface facing the fourth surface, and a sixth surface opposite to the fifth surface, and wherein the fifth surface has a structure placement area in which the antenna structure is disposed.

12. The electronic device of claim 11, wherein the structure placement area includes:

a first area corresponding to a corresponding area of the fourth surface extending from the first side surface;

a second area corresponding to a corresponding area of the fourth surface extending from the second side surface;

a third area corresponding to a corresponding area of the fourth surface extending from the third side surface; and a fourth area corresponding to a corresponding area of the fourth surface extending from the fourth side surface, and wherein the first area includes a nonconductive material.

13. The electronic device of claim 12, wherein the wireless communication circuit is disposed on the first surface of the PCB, and wherein the antenna structure further includes an opening configured to accommodate the wireless communication circuit.

14. The electronic device of claim 12, further comprising an electrical connection structure configured to electrically connect the wireless communication circuit to the device substrate.

15. The electronic device of claim 14, wherein the electrical connection structure is disposed at a location opposite to the second antenna array.

16. The electronic device of claim 14, wherein the antenna structure is further fixed to the device substrate and/or the PCB while avoiding an area overlapped with the electrical connection structure and/or the second antenna array when the first plate is viewed from above.

17. The electronic device of claim 14, wherein the electrical connection structure includes:

at least one third conductive contact disposed to the first surface of the PCB and electrically connected to the wireless communication circuit;

at least one fourth conductive contact disposed to the third surface from one end of a conductive via disposed in the space of the antenna structure, and facing the at least one third conductive contact;

at least one fifth conductive contact disposed to the fourth surface from other end of the conductive via; and a sixth conductive contact disposed at a location facing the at least one fifth conductive contact in the fifth surface of the device substrate.

18. The electronic device of claim 3, further comprising a display disposed to be visible to an outside through the first plate, wherein the first plate is disposed to cover a peripheral area between the display and the lateral member, and wherein the second antenna array is disposed at a position overlapping the peripheral area when the first plate is viewed from above.

19. The electronic device of claim 3, wherein at least a portion of the lateral member is formed as a nonconductive area including a nonconductive material, and wherein the wireless communication circuit is further configured to form a beam pattern at least in a direction of the nonconductive area through the second antenna array.

20. An electronic device, comprising:

a housing including a first plate facing a first direction and a second plate facing a second direction opposite the first direction;

a printed circuit board (PCB) disposed within the housing; and an antenna structure disposed on the PCB, wherein the PCB includes at least one first conductive contact configured to electrically connect to a wireless communication circuit, a first surface facing the first direction, and a second surface facing the second direction, wherein the antenna structure includes an antenna element, at least one second conductive contact configured to electrically connect to the antenna element, a third surface facing the second surface, and a fourth surface opposite to the third surface, wherein at least a part of the at least one first conductive contact is exposed to at least a portion of the first surface, and the at least one second conductive contact is exposed to the third surface, and wherein the at least one first conductive contact is configured to electrically connect to the at least one second conductive contact when the third surface meets the first surface.

* * * * *